US008511456B1

(12) United States Patent
Albertson et al.

(10) Patent No.: US 8,511,456 B1
(45) Date of Patent: Aug. 20, 2013

(54) PERMANENT MAGNET AIR HEATER

(71) Applicant: PowerMag, LLC, Chicago, IL (US)

(72) Inventors: Robert V. Albertson, Alma, WI (US); David Albertson, Mound, MN (US)

(73) Assignee: PowerMag, LLC, Chicago, IL (US)

( * ) Notice: Subject to any disclaimer, the term of this patent is extended or adjusted under 35 U.S.C. 154(b) by 0 days.

(21) Appl. No.: 13/706,422

(22) Filed: Dec. 6, 2012

Related U.S. Application Data

(63) Continuation of application No. 13/677,474, filed on Nov. 15, 2012, which is a continuation of application No. 13/606,084, filed on Sep. 7, 2012, now Pat. No. 8,418,832, which is a continuation-in-part of application No. 12/658,398, filed on Feb. 12, 2010, now Pat. No. 8,283,615.

(60) Provisional application No. 61/217,784, filed on Jun. 5, 2009.

(51) Int. Cl.
*H05B 6/22* (2006.01)

(52) U.S. Cl.
USPC ..... 198/370.09; 219/654; 219/628; 219/631

(58) Field of Classification Search
None
See application file for complete search history.

(56) References Cited

U.S. PATENT DOCUMENTS

| | | | | |
|---|---|---|---|---|
| 2,549,362 | A | | 4/1951 | Bessiere et al. |
| 3,310,652 | A | | 3/1967 | Williams |
| 3,671,714 | A | | 6/1972 | Charns |
| 3,846,617 | A | * | 11/1974 | Glucksman ..... 392/368 |
| 4,199,545 | A | | 4/1980 | Matovich |
| 4,217,475 | A | | 8/1980 | Hagerty |
| 4,511,777 | A | * | 4/1985 | Gerard ..... 219/631 |
| 4,600,821 | A | | 7/1986 | Fitchter et al. |
| 4,614,853 | A | * | 9/1986 | Gerard et al. ..... 219/631 |
| 5,012,060 | A | | 4/1991 | Gerard et al. |
| 5,773,798 | A | | 6/1998 | Fukumura |
| 5,914,065 | A | | 6/1999 | Alavi |
| 5,981,919 | A | | 11/1999 | Masten |
| 6,011,245 | A | | 1/2000 | Bell |
| 6,297,484 | B1 | | 10/2001 | Usui et al. |
| 6,780,225 | B2 | * | 8/2004 | Shaw et al. ..... 95/273 |
| 7,339,144 | B2 | * | 3/2008 | Lunneborg ..... 219/631 |
| 7,573,009 | B2 | | 8/2009 | Lunneborg et al. |
| 7,595,470 | B1 | | 9/2009 | Sizer et al. |
| 2005/0006381 | A1 | | 1/2005 | Lunneborg et al. |
| 2009/0223948 | A1 | | 9/2009 | Hess |

OTHER PUBLICATIONS

YouTube Screenshot of MagTec Energy XE 500 Portable Heater, downloaded from http://www.youtube.com/watch?v=CyNfiRJcI5M&feature=youtube_gdata_player on Oct. 31, 2012, 1 page.

* cited by examiner

*Primary Examiner* — Kavel Singh
(74) *Attorney, Agent, or Firm* — Eric L. Sophir; Dentons US LLP

(57) ABSTRACT

A permanent magnet air heater has a housing with an internal chamber accommodating an electric motor rotating a fan to move air through the housing. A non-ferrous member having bores for cylindrical magnets and a steel member with a copper plate secured to the steel member are rotated relative to each other by the motor whereby the magnetic field between the magnets and copper plate generates heat which is transferred to air in the housing moving through the housing by the fan.

20 Claims, 32 Drawing Sheets

2200

PERMANENT MAGNET AIR HEATER

CROSS REFERENCE TO RELATED APPLICATIONS

This application is a continuation application of U.S. patent application Ser. No. 13/677,474, filed on Nov. 15, 2012, entitled "Permanent Magnet Air Heater," which is a continuation of U.S. patent application Ser. No. 13/606,084, filed on Sep. 7, 2012, entitled "Permanent Magnet Air Heater," which is a continuation-in-part of U.S. patent application Ser. No. 12/658,398, filed on Feb. 12, 2010 entitled "Permanent Magnet Air Heater," which claims priority to U.S. Provisional Application 61/217,784, filed on Jun. 5, 2009, all of which are hereby incorporated herein by reference in their entirety.

FIELD OF THE INVENTION

The invention is in the field of space air heaters having permanent magnets that generate magnetic fields creating heat.

BACKGROUND OF THE INVENTION

Space heaters having electrical resistance coils to heat air moved with motor driven fans are in common use to dry objects and heat rooms. The heaters comprise housings surrounding electric motors and fans driven by the electric motors. Guide supporting electrical resistance elements located in the housings are connected to electric power sources to increase the temperature of the elements. The electrical resistance elements are very hot when subjected to electrical power. This heat is transmitted by conduction to air moved by the fans adjacent the electrical resistance elements. These heaters require substantial amounts of electric energy and can be electric and fire hazards. Magnetic fields of magnets have also been developed to generate heat. The magnets are moved relative to a ferrous metal member to establish a magnetic field which generates heat to heat air. Examples of heaters having magnets are disclosed in the following U.S. Patents.

Bessiere et at in U.S. Pat. No. 2,549,362 discloses a fan with rotating discs made of magnetic material fixed to a shaft. A plurality of electromagnets are fixed adjacent to the rotating discs. The eddy currents generated by the rotating discs produce heat which heats the air blown by the fan to transfer heat to a desired area.

Charms in U.S. Pat. No. 3,671,714 discloses a heater-blower including a rotating armature surrounded by a magnetic field formed in the armature by coils. The armature includes closed loops that during rotation of the armature generates heat through hysteresis losses. A motor in addition to generating heat also powers a fan to draw air across the heated coils and forces the air into a passage leading to a defroster outlet.

Gerard et at in U.S. Pat. No. 5,012,060 discloses a permanent magnet thermal heat generator having a motor with a drive shaft coupled to a fan and copper absorber plate. The absorber plate is heated as it is rotated relative to permanent magnets. The fan sucks air through a passage into a heating chamber and out of the heating chamber to a desired location.

Bell in U.S. Pat. No. 6,011,245 discloses a permanent magnet heat generator for heating water in a tank. A motor powers a magnet rotor to rotate within a ferrous tube creating eddy currents that heats up the tube and working fluid in a container. A pump circulates the working fluid through the heating container into a heat transfer coil located in the tank.

Usui et at in U.S. Pat. No. 6,297,484 discloses a magnetic heater for heating a radiator fluid in an automobile. The heater has a rotor for rotating magnets adjacent an electrical conductor. A magnetic field is created across the small gap between the magnets and the conductor. Rotation of the magnets slip heat is generated and transferred by water circulating through a chamber.

SUMMARY OF THE INVENTION

The invention is an apparatus for heating air and discharging the heated air into an environment such as a room. The apparatus is an air heater having a housing surrounding an internal chamber. The housing has an air inlet opening and an air exit opening covered with screens to allow air to flow through the housing. A motor located in the chamber drives a fan to continuously move air through the chamber and discharge hot air from the chamber. The hot air is generated by magnetic fields established with permanent magnets and a ferrous metal member. A copper absorber plate mounted on the ferrous metal member between the magnets and ferrous metal member is heated by the magnetic fields. The heat is dissipated to the air in the chamber. The permanent magnets are cylindrical magnets located in cylindrical bores in a non-ferrous member, such as an aluminum member, to protect the magnets from corrosion, breaking, cracking and fissuring. The motor operates to rotate the ferrous member and copper member and non-ferrous member and magnets relative to each other to generate a magnet force field thereby heating air in the chamber. The heated air is moved through the chamber by the fan and discharged to the air exit opening to atmosphere.

In one embodiment, a heater comprises an absorber plate proximate to a ferrous member; a plurality of permanent magnets mounted on a non-ferrous member that is adjacent to the absorber plate, wherein each magnet is adjacent to a magnet of opposite polarity; a first drive operable by a first motor to rotate the non-ferrous member, including the permanent magnets, relative to the ferrous member to generate a magnetic field, thereby generating heat; and a plurality of fins that transfer heat away from the ferrous member.

In another embodiment, a heater comprises an absorber plate proximate to a ferrous member; a plurality of permanent magnets mounted on a non-ferrous member that is adjacent to the absorber plate, wherein each magnet is adjacent to a magnet of opposite polarity, and wherein at least one magnet is adjacent to another magnet of the same polarity; a first drive operable by a first motor to rotate the ferrous member and absorber plate relative to the non-ferrous member, including the plurality of magnets to generate a magnetic field, thereby generating heat; and a plurality of fins that transfer heat away from the ferrous member.

In yet another embodiment, a heater comprises a rotor including a plurality of fins, an absorber plate, and ferrous plate configured to rotate within a heating housing that has an inlet for receiving fluid and an outlet for discharging fluid, wherein fluid is discharged through the outlet by the rotation of the plurality of fins; a plurality of permanent magnets mounted on a non-ferrous member, each magnet is adjacent to a magnet of opposite polarity; and a motor operable to rotate a drive that rotates the rotor within the heating housing to generate a magnetic field, thereby generating heat that heats the fluid within the heating housing.

In still yet another embodiment, a heater comprises absorber tubing proximate to a ferrous member; a plurality of permanent magnets mounted on a non-ferrous member that is adjacent to the absorber tubing, wherein each magnet is adjacent to a magnet of opposite polarity; and a drive operable by a motor to rotate the non-ferrous member, including the permanent magnets, relative to the ferrous member to generate a magnetic field, thereby generating heat, wherein fluid flows through the absorber tubing and is heated as the fluid flows through the absorber tubing.

In another embodiment, a heater comprises a copper tank; a ferrous member proximate to and touching one side of the copper tank; a plurality of permanent magnets mounted on a non-ferrous member that is adjacent to the one side of the copper tank, wherein each magnet is adjacent to a magnet of opposite polarity; and a drive operable by a motor to rotate the non-ferrous member, including the permanent magnets, relative to the ferrous member to generate a magnetic field, thereby generating heat in the copper tank.

Additional features and advantages of an embodiment will be set forth in the description which follows, and in part will be apparent from the description. The objectives and other advantages of the invention will be realized and attained by the structure particularly pointed out in the exemplary embodiments in the written description and claims hereof as well as the appended drawings.

It is to be understood that both the foregoing general description and the following detailed description are exemplary and explanatory and are intended to provide further explanation of the invention as claimed.

DETAILED DESCRIPTION

Figure 1:
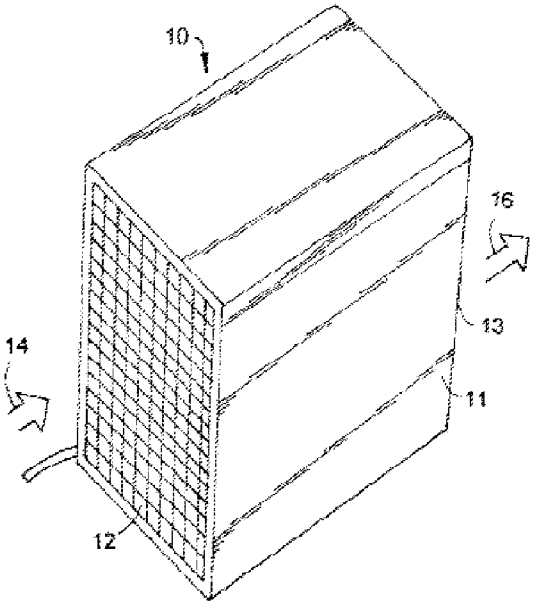
FIG. 1 is a perspective view of a first embodiment of the permanent magnet air heater of the invention.
Figure 2:
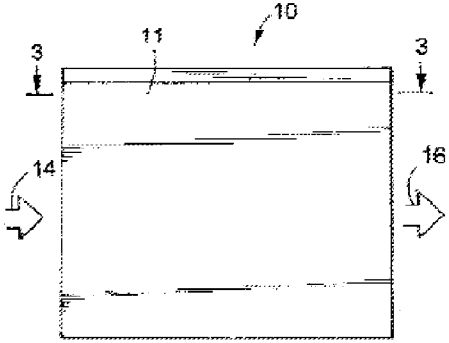
FIG. 2 is a side elevational view thereof.

A first embodiment of a magnet heat generator 10, shown in FIGS. 1 to 7, has a box-shaped housing 11 with open opposite ends to allow air to flow through mesh screens 12 and 13 shown by arrows 14 and 16. Screens 12 and 13 secured to opposite ends of housing 11 prevent access to the interior chamber 17 of housing 11. Screen 12 can include air filter media operable to collect dust, dirt, pollen and other airborne particulates.

Figure 5:
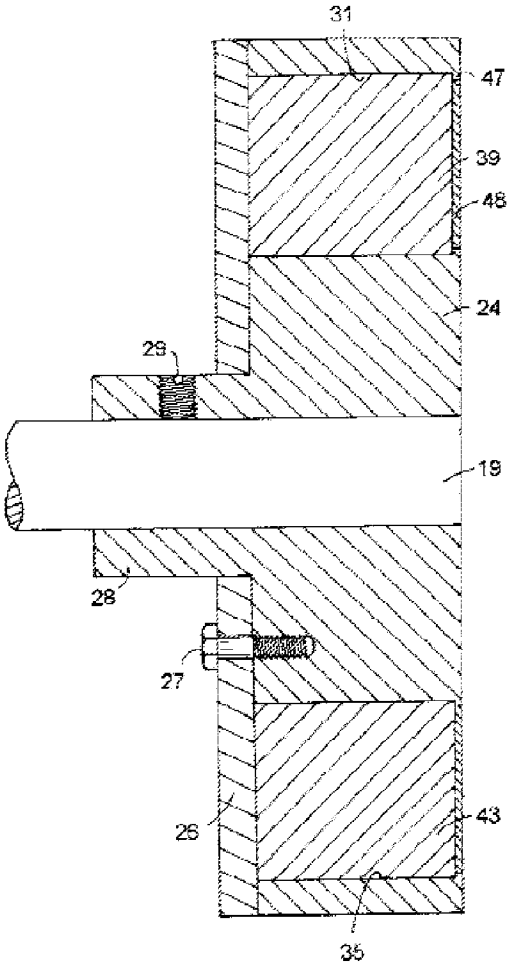
FIG. 5 is a sectional view taken along line 5-5 of FIG. 4.
Figure 6:
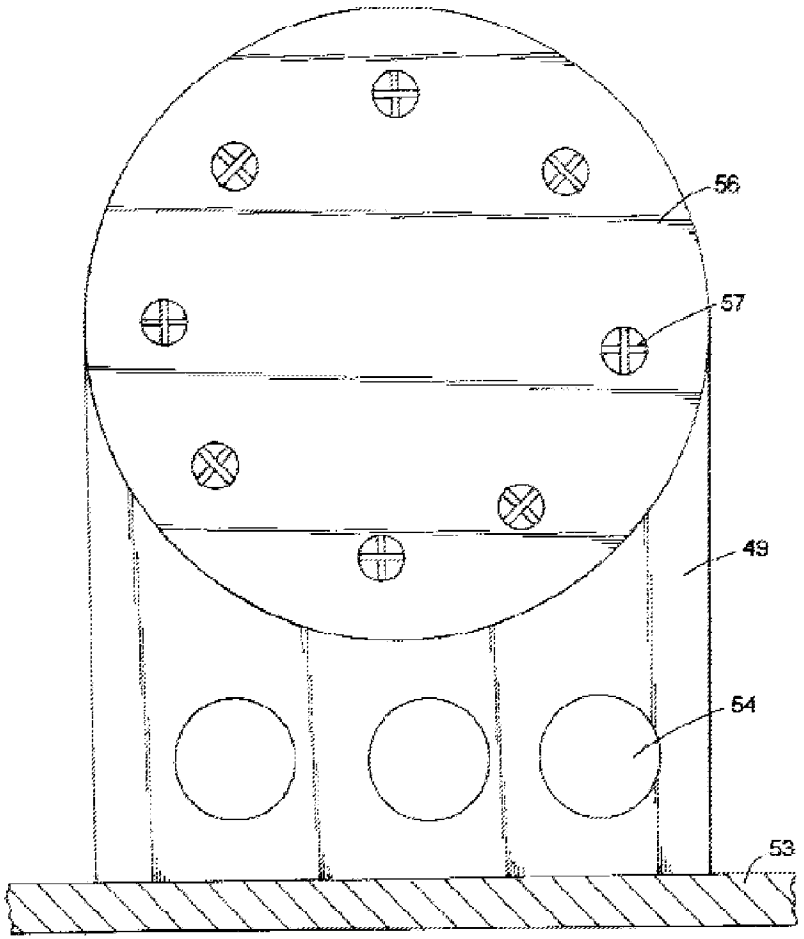
FIG. 6 is an enlarged sectional view taken along the line 6-6 of FIG. 3.

An electric motor 18 located in chamber 17 and mounted on housing 11 includes a drive shaft 19 coupled to an air moving device 21 shown as a disk with blades or fan to move air shown by arrows 22 through chamber 17. Motor 18 is a prime mover which includes air and hydraulic operated motors and internal combustion engines. Other types of fans can be mounted on drive shaft 19 to move air through chamber 17. A rotor 23 mounted on drive shaft 19 adjacent air moving device 21 supports a plurality of permanent magnets 39-46 having magnetic force fields used to generate heat which is transferred to the air moving through chamber 17 of housing 11. Rotor 23 comprises a non-ferrous or aluminum disk 24 and an annular non-ferrous plate 26 secured with fasteners 27, such as bolts, to the back side of disk 24. As shown in FIG. 5, disk 24 has a hub 28 with a bore accommodating drive shaft 19 of motor 18. A set screw 29 threaded in a bore in hub 28 secures hub 28 to shaft 19. Other types of connecting structures, such as keys or splines, can be used to secure hub 28 and disk 24 to shaft 19. Annular plate 26 can be an aluminum or ceramic plate.

Figure 4:
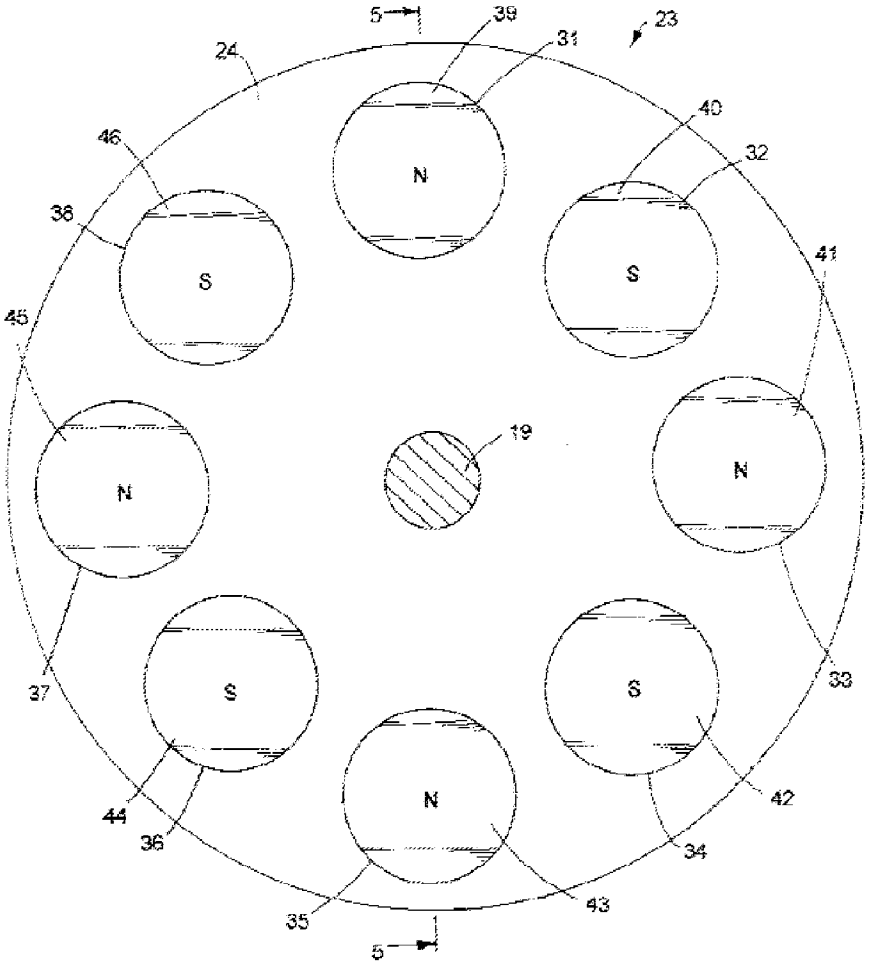
FIG. 4 is an enlarged sectional view taken along the line 4-4 of FIG. 3.

Returning to FIGS. 4 and 5, disk 24 has cylindrical bores 31-38 circumferentially spaced in a circular arrangement around the disk. The bores 31-38 are spaced radially inwardly adjacent the outer cylindrical surface of the disk. The bores 31-38 have uniform diameters and extended through disk 24. Permanent magnets 39-46 are cylindrical neodymium magnets having uniform outer cylindrical walls located in surface engagement with the inside cylindrical walls of bores 31-38. The edges of the cylindrical magnets are rounded to reduce chipping and breaking. An example of a neodymium cylindrical magnet is a NdFeB magnet having a 1-inch diameter, f-inch length and a pall force of about 74 pounds. The magnets can be coated with nickel to inhibit corrosion and strengthen the magnet material. The magnets can also be coated with plastic or rubber to weatherproof the magnet material. Adjacent magnets have alternate or North South polarities, shown by N and S in FIG. 4. As shown in FIG. 5, disk 24 has circular lips or flanges 47 at the outer ends of bores 31-38 that are stops to retain magnets 39-46 in the bores. Coatings 48, such as glass, plastic or rubber members, till the spaces surrounded by lips 47. Magnets 39-46 are enclosed within bores 31-38 of disk 24. The annular plate 26 closes the rear ends of bores 31-38. The disk 24 and plate 26 protect the magnets 39-46 from corrosion, breaking, cracking and fissuring. Eight circumferentially spaced magnets 39-46 are shown in FIG. 4. The number, size and type of magnets mounted on disk 24 can vary. Also, an additional circular arrangement of magnets can be added to disk 24.

Figure 3:
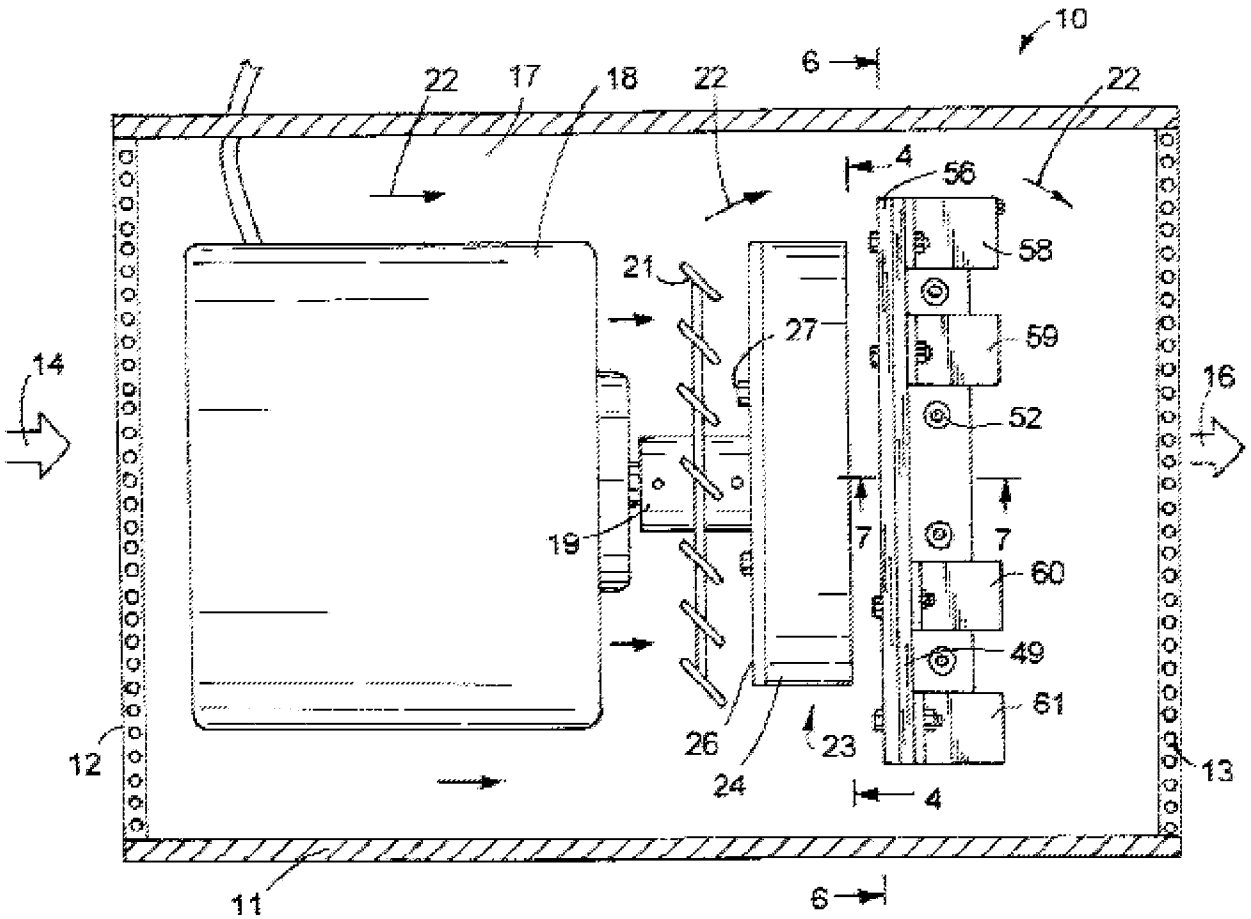
FIG. 3 is an enlarged sectional view taken along the line 3-3 of FIG. 2.
Figure 7:
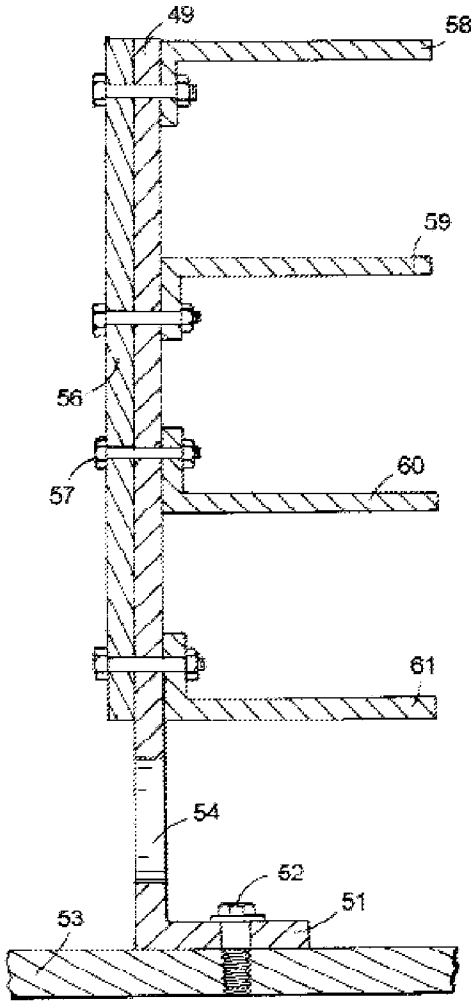
FIG. 7 is an enlarged sectional view taken along the line 7-7 of FIG. 3.
Figure 8:
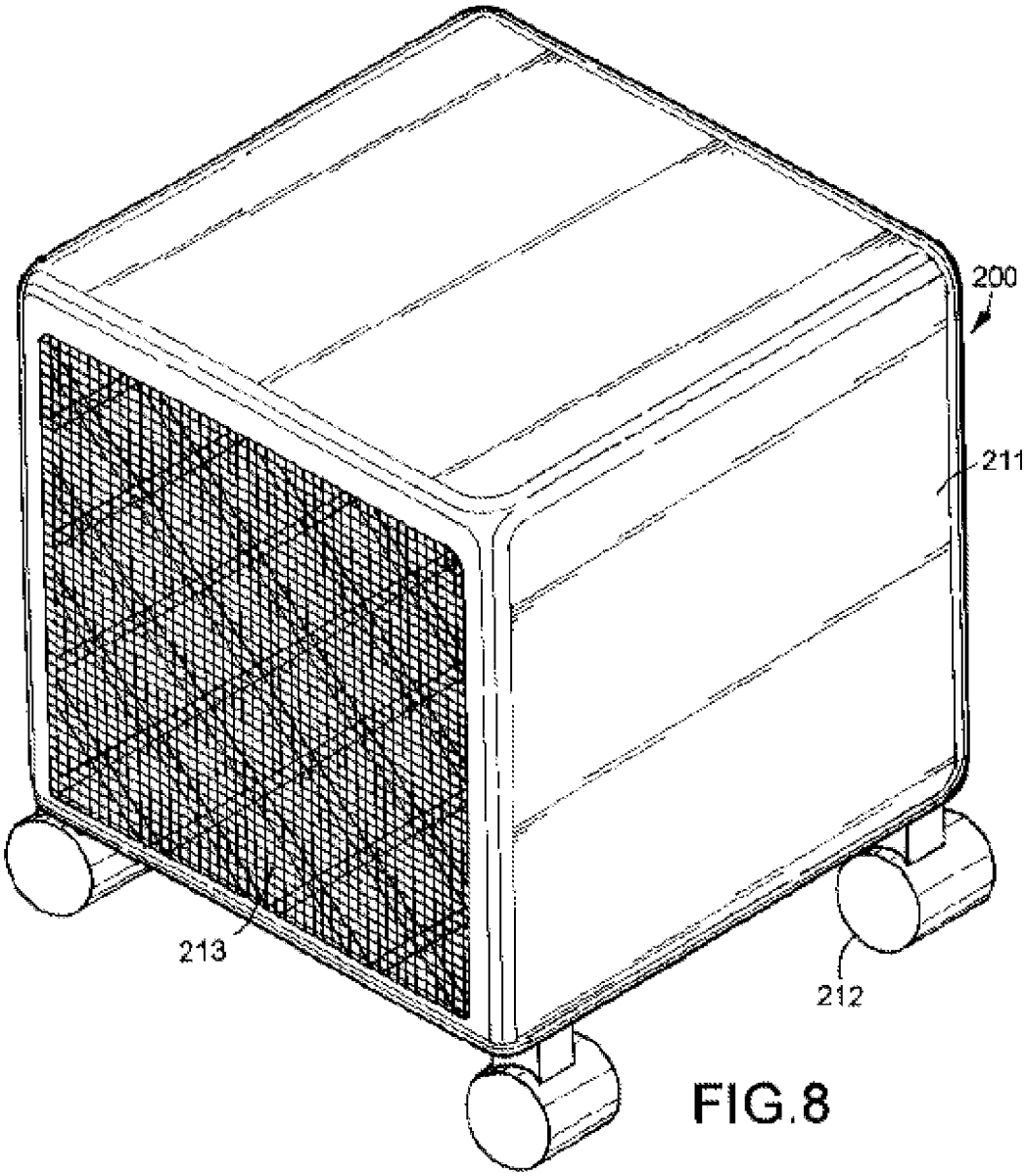
FIG. 8 is a perspective view of a second embodiment of the permanent magnet air heater of FIG. 1.
Figure 9:
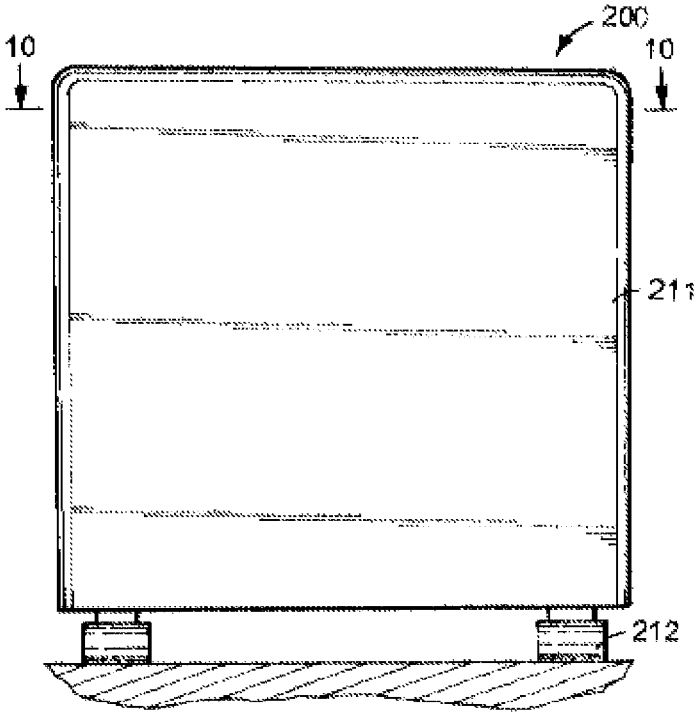
FIG. 9 is a side elevational view of FIG. 8.
Figure 10:
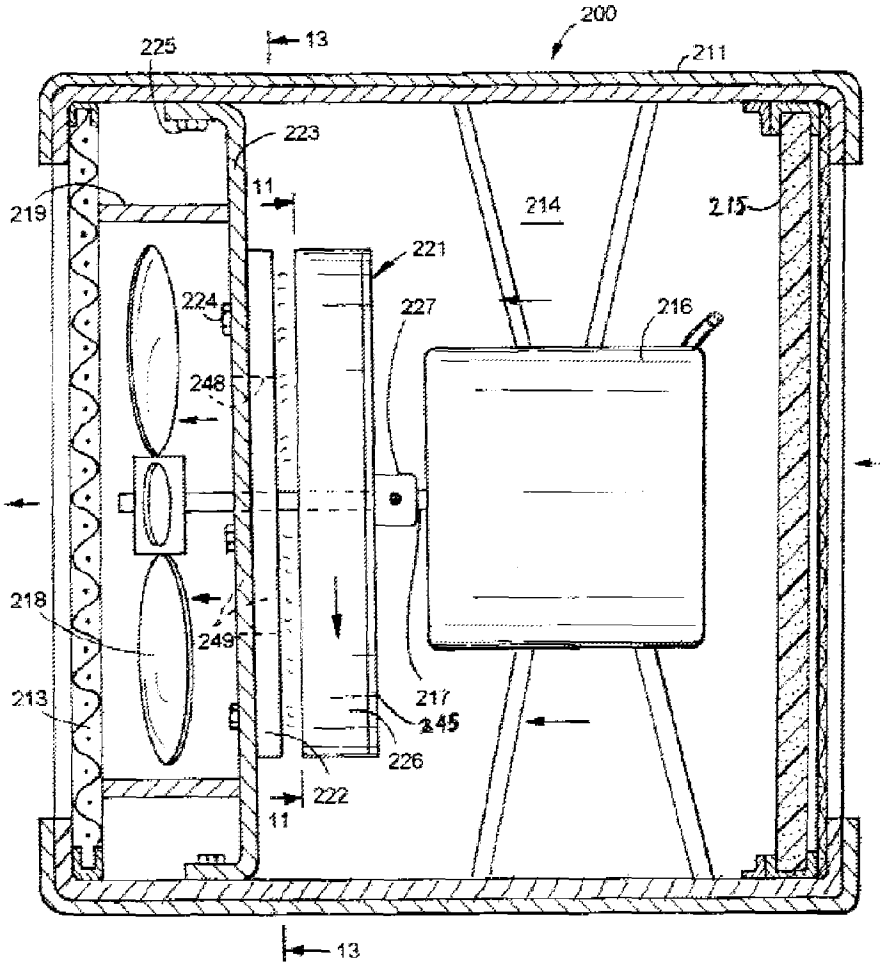
FIG. 10 is an enlarged sectional view taken along line 10-10 of FIG. 9.
Figure 11:
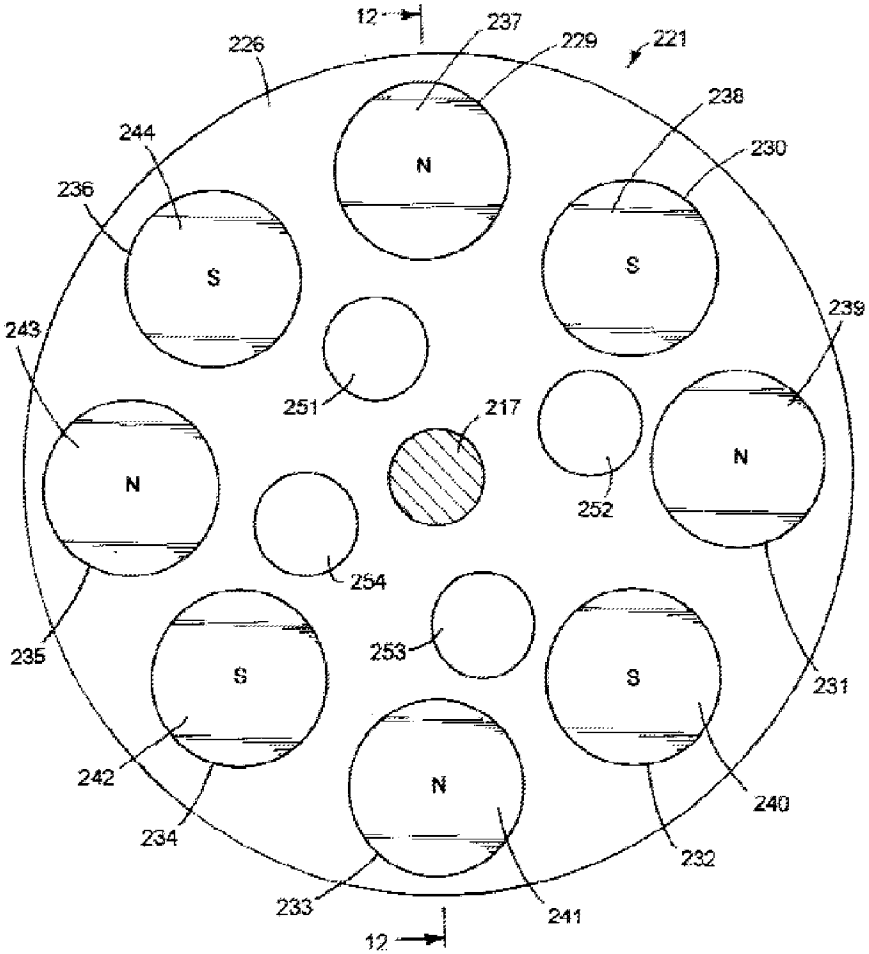
FIG. 11 is an enlarged sectional view taken along line 11-11 of FIG. 10.

Returning to FIG. 3 and FIG. 6, a steel plate 49 is secured with bolts 52 to base 53 of housing 11. Plate 49 extends upwardly into chamber 17 rearward of rotor 23. Plate 49 is a ferrous metal member. A copper absorber plate or disk 56 is attached with fasteners 57 to plate 49. Copper disk 56 has a back side in surface contact with the adjacent surface of plate 49. The front side of copper disk 56 is axially spaced from rotor 23. As shown in FIGS. 3 and 7, plurality of fins or tabs 58-61 attached to plate 49 conduct heat from plate 49 which is transferred to air moving in chamber 17. The air flowing around copper disk 56 and plate 49 is heated. The hot air continues to flow through holes 54 in plate 49 to the exit opening of housing 11.

In use, motor 18 rotates air moving device 21 and rotor 23. The magnets 39-46 are moved in a circular path adjacent cooper disk 56. The magnetic forces between magnets 39-46 and steel plate 49 generates heat which increases the temperature of copper disk. 56. Some of the heat from copper disk 56 is conducted to steel plate 49 and fins 58-61 and other heat is transferred to the air around copper disk 56. The air surrounding motor 18 is also heated. The heated air is moved through chamber 17 and discharged to the environment adjacent exit screen 13, shown by arrow 16.

A second embodiment of the heat generator or heater 200, shown in FIGS. 8 to 13, has a box-shaped housing 211 supported on a surface with wheels 212. A screen 213 is located across the air exit opening of housing 211. An air filter 215 extends across the air entrance opening of housing 211. The air flowing through housing interior chamber 214 is heated and dispensed as hot air into the environment around heat generator 200.

Figure 12:
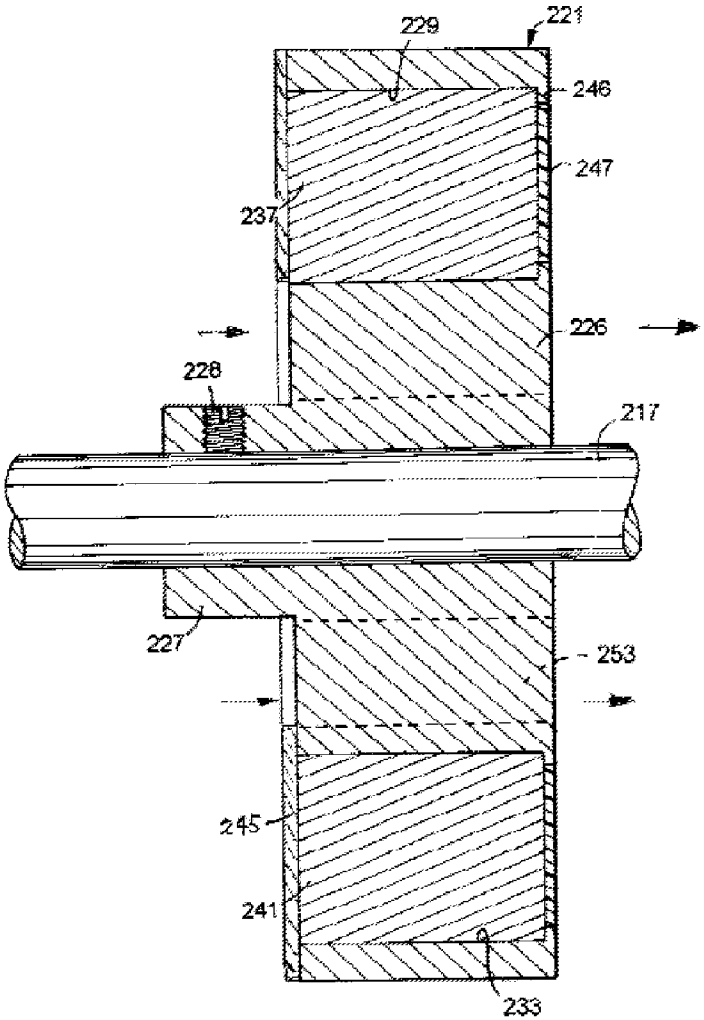
FIG. 12 is a sectional view taken along line 12-12 of FIG. 11.
Figure 13:
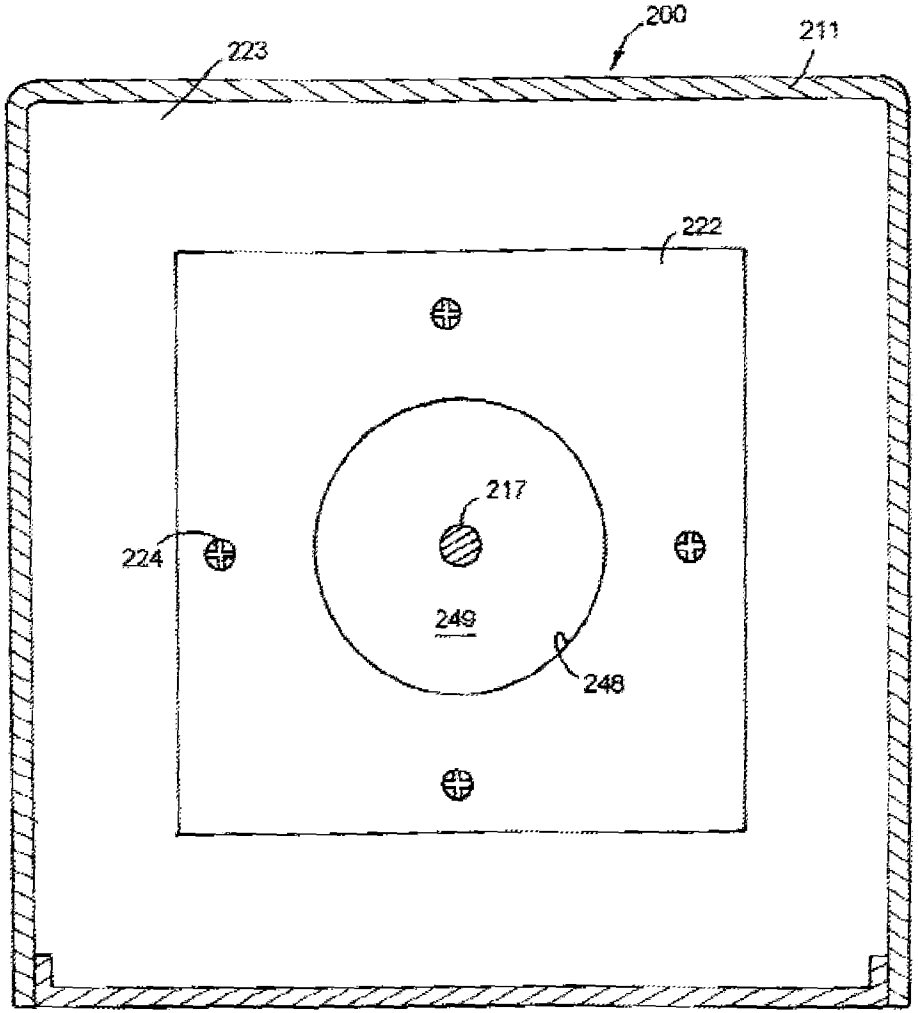
FIG. 13 is a sectional view taken along line 13-13 of FIG. 10.

An electric motor 216 mounted on the base of housing 211 has a diverse shaft 217. A fan 218 mounted on the outer end of shaft 217 is rotated when motor 216 is operated to move air through chamber 214. A sleeve 219 surrounding fan 218 spaces the fan from screen 213. A rotor 221 mounted on drive shaft 217 is also rotated by motor 216. Motor 216 is a prime mover which includes but is not limited to electric motors, air motors, hydraulic operated motors and internal combustion engines. Rotor 221, shown in FIGS. 11 and 12, comprises non-ferrous or aluminum disk 226 having a hub 227. Hub 227 and disk 226 have a common axial bore accommodating motor drive shaft 217. A set screw 228 threaded into hub 227 secures hub 227 to shaft 217. A set screw 228 threaded into hub 227 secures hub 227 to shaft 217. Other devices, such as keys and splines, can be used to secure hub 227 and disk 226 to shaft 217. Disk 226 has a plurality of circumferentially arranged axial bores 229-236. Cylindrical permanent magnets 237-244 are located within bores 229-236. Adjacent magnets have N and S polarities. Disk 226, as seen in FIG. 12, has circular lips 246 at the outer ends of bores 229-236 that function as stops to retain magnets 237-244 in bores 229-236. Coatings 247, such as glass, plastic or rubber members, fill the spaces surrounded by lips 246. Coatings can also be applied to the inner ends of magnets 237-244. Also, a non-ferrous or aluminum plate 245 secured to disk 226 covers the inner ends of magnets 237-244. Magnets 237-244 located within disk 226 are protected from corrosion, breaking, cracking and fissuring. Magnets 237-244 are cylindrical neodymium permanent magnets having uniform outer cylindrical walls located in surface engagement with the inside cylindrical walls of bores 229-236. The number, size and types of magnets mounted on disk 226 can vary.

In use, motor 216 concurrently rotates rotor 226 and fan 218. Air is drawn through air filter 215 into chamber 214. The air cools motor 216 and flows in the gap or space between rotor 221 and copper disk 222 and through opening 249 and out through screen 213 to the outside environment around heater 200. The eddy currents or magnetic force geld in the space between rotor 221 and copper disk 222 generate heat that increases the temperature of copper disk 222 and steel plate 223. This heat is transferred to the air moving around copper plate 222 and steel plate 223. Fan 218 moves the hot air through screen 213 to the outside environment.

A third embodiment of the heat generator or heater 300, shown in FIGS. 14 to 17, has a box-shaped housing 310 removably mounted on a base 312. Housing 310 surrounds an interior chamber 311. A first screen 313 and air filter 314 extend across the air inlet opening to chamber 311. A second screen 316 extends across the air outlet opening of heater 300. The air flowing through interior chamber 311 is heated and dispensed as hot air into the environment around heater 300.

Figure 16:
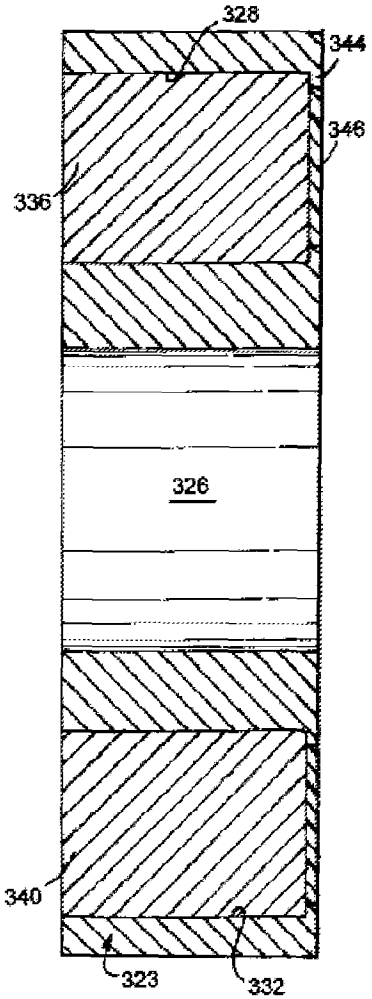
FIG. 16 is a sectional view taken along the line 16-16 of FIG. 15.
Figure 17:
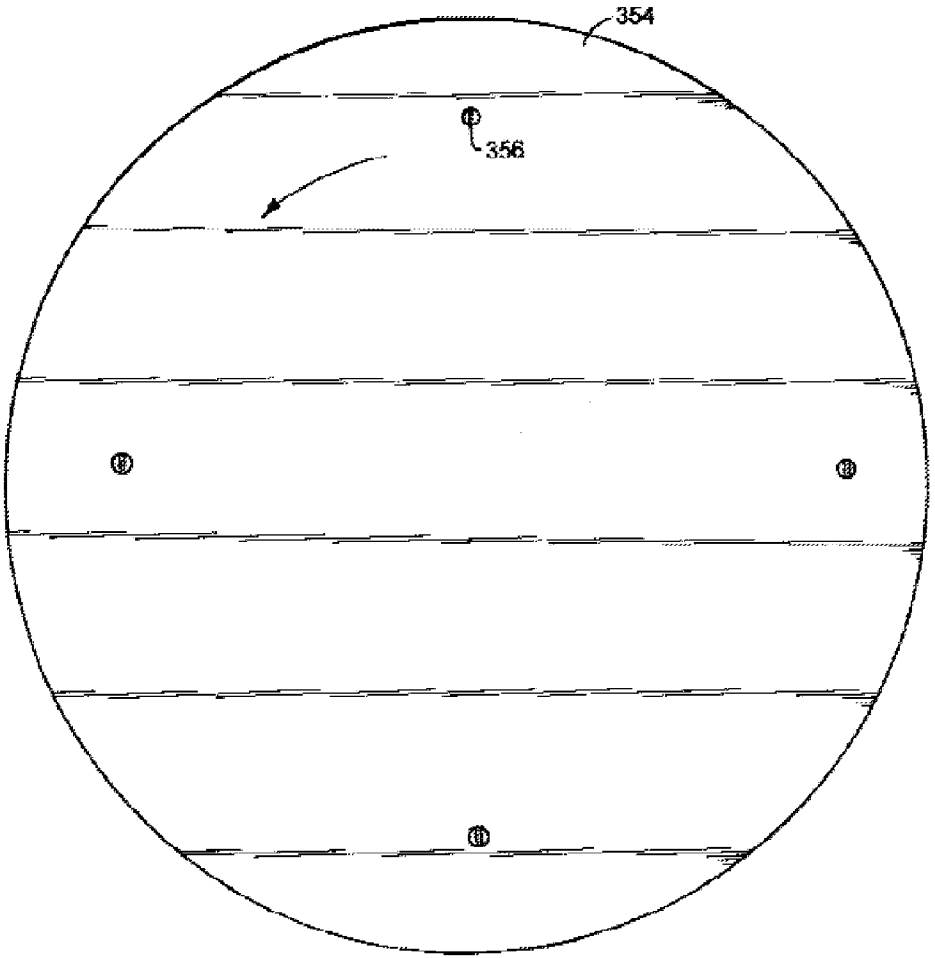
FIG. 17 is an enlarged sectional view taken along, the line 17-17 of FIG. 14.

A primer mover 347 shown as an electric motor, is mounted on base 312 with supports 348. Supports 348 can be resilient mount members to reduce noise and vibrations. Motor drive shaft 348 supports a fan 351. The fan 351 has a hub 352 secured to shaft 349. A steel or ferrous metal disk 353 is secured to the outer end of shaft 349 adjacent fan 351. A copper absorber plate 354 is attached with fasteners 356 to steel disk 353. Copper plate 354 is located in flat surface engagement with the adjacent flat surface of steel desk 353. A non-ferrous or aluminum plate 317 secured with fasteners 318 to base 312 extends upward into chamber 311. A sleeve 322 spaces plate 317 from screen 316 and directs air flow to screen 316. An aluminum annular member or body 323 is secured to plate 317 with fasteners 324. Body 323 has a central opening 326 to allow air to flow through chamber 311. Body 323, shown in FIG. 15, has a plurality of circular spaced cylindrical bores 328-335 accommodating cylindrical permanent magnets 336-343. The magnets 336-343 are cylindrical neodymium permanent magnets having uniform outer cylindrical walls located in surface engagement with the inside cylindrical walls of bores 328-335. Adjacent magnets have opposite polarities shown as N and S. The number, size and types of magnets mounted on body 323 can vary. As shown in FIG. 16, body 323 has circular lips or flanges 344 at the forward ends of bores 328-335 that function as stops to retain magnets 336-343 in bores 328-335. Coatings 346 located in the spaces surrounded by lips 344 protect the magnets 336-343. Body 323, plate 317 and coatings 346 protect magnets 336-343 from corrosion, breaking, cracking and fissuring.

Figure 14:
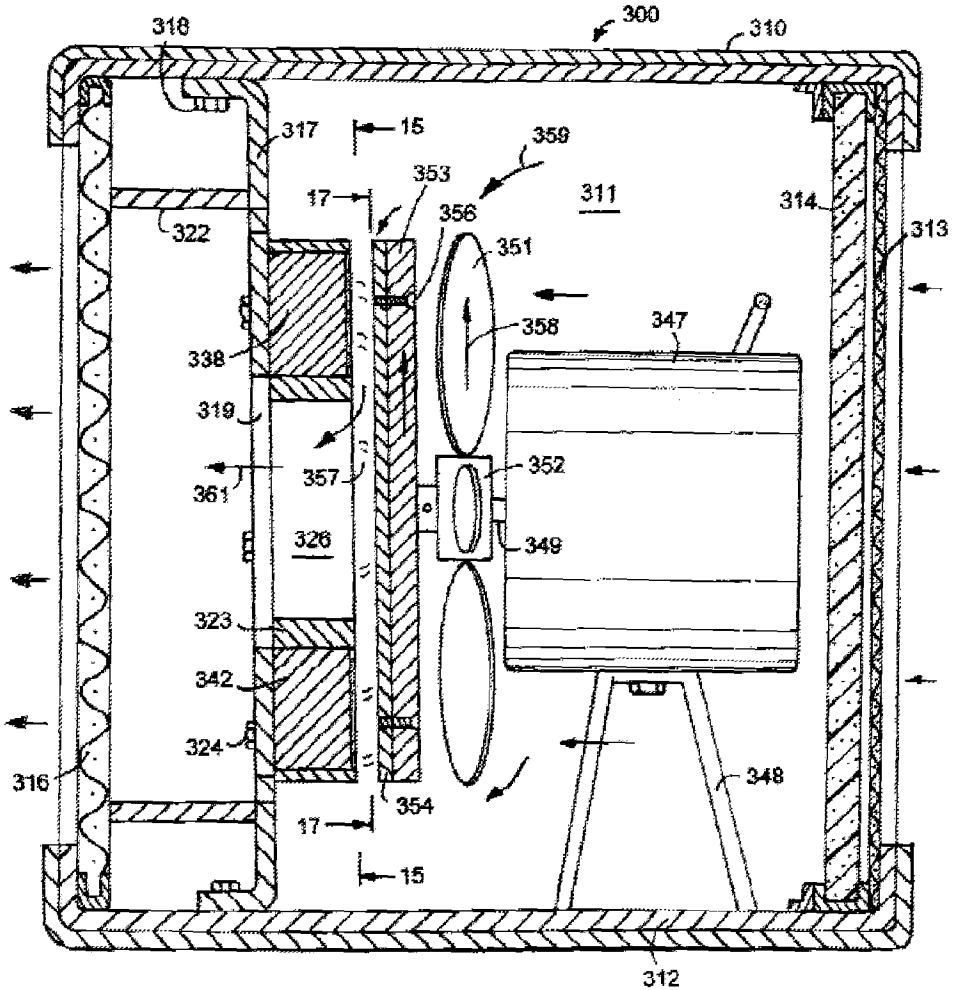
FIG. 14 is a sectional view similar to FIG. 10 of a third embodiment of the permanent magnet heater of FIG. 1.
Figure 15:
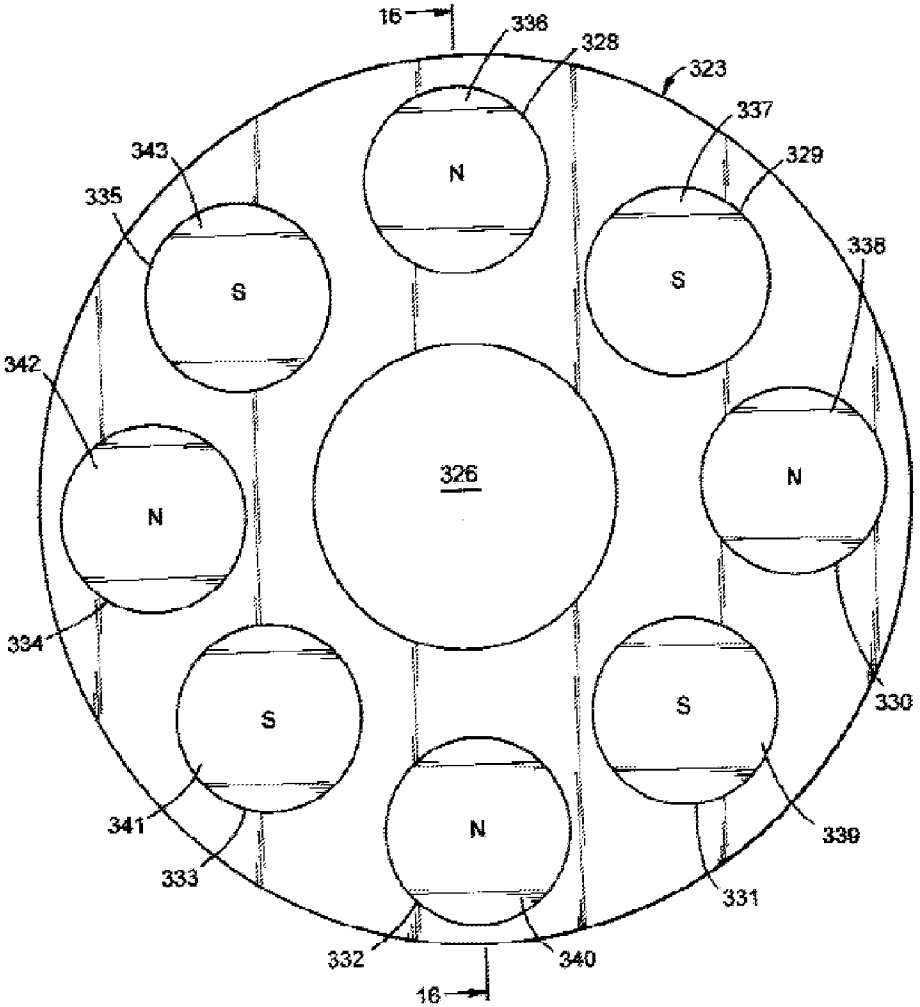
FIG. 15 is an enlarged sectional view taken along the line 15-15 of FIG. 14.

In use, as shown in FIG. 14, motor 347 rotates fan 351 shown by arrow 358 and steel disk 353 and copper plate 354 relative to body 323 and magnets 336-343. Eddy currents in the gap or space between copper plate 354 and magnets 336-343 generate heat that heats copper plate 354. The heat is transferred to air moving around copper plate 354. Hot air flows through opening 326, shown by arrow 361 to screen 318 and into the environment around heat generator 300.

Figure 18A:
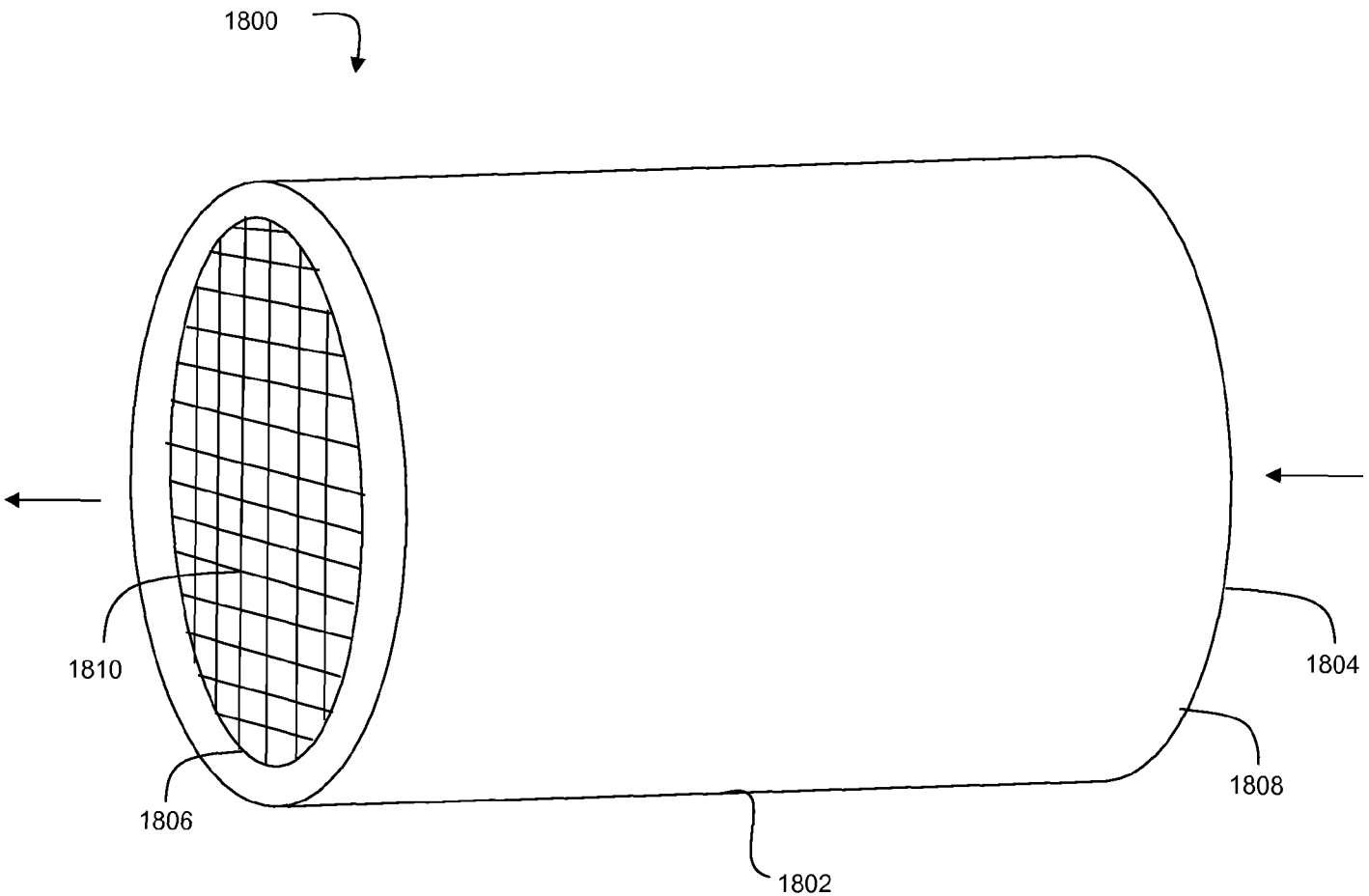
FIG. 18A is a perspective view of a fourth embodiment of a permanent magnet air heater according to the exemplary embodiments.

A fourth embodiment of a magnet heater 1800 is illustrated in FIGS. 18A-18F. Referring to FIG. 18A, a cylindrical shaped housing 1802 includes a first opening 1804 and a second opening 1806. The first and second openings may be covered with a first screen 1808 and a second screen 1810, respectively, or the first and second screens 1808, 1810 may be omitted. If the first and second screens 1808, 1810 are included, air filters may further be included with the first and second screens 1808, 1810.

The magnet heater 1800 according to the fourth embodiment may be used for crop drying purposes. Crop drying may include applying heat to or moving air through produce to remove moisture from harvested produce. While crop drying is used as an exemplary intended use of the magnet heater 1800, the magnet heater 1800 according to the fourth embodiment may also be useful in removing moisture from other types of materials, such as fabric or paint. To accommodate the crop dying application, a relatively large housing, which houses relatively large components, may be used in the fourth embodiment of the magnet heater 1800. Thus, the housing 1802 and internal components within the housing 1802 may be appreciably larger in size from the housing and internal components of the first through third embodiments of the magnet heater. While the housing 1802 may be larger in size than the housings of the first through third embodiments of the magnet heater, the fourth embodiment of the magnet heater 1800 may also include a housing 1802 of similar size as the first through third embodiments, or a housing 1802 of smaller size than the first through third embodiments. It should also be noted that depending on the application of the magnet heater 1800, a housing 1802 may be omitted. For illustration purposes, the fourth embodiment of the magnet heater 1800 will be assumed to have a relatively large housing 1802.

As shown in FIG. 18A, air flows through the first opening 1804 and out the second opening 1806. The housing 1802, while illustrated as horizontal in FIG. 18A, may be positioned vertically. By positioning the housing vertically, cool air may enter the first opening 1804, and hot air may rise out of the second opening 1806 after the air is heated inside of the housing 1802. Air flow may be created by using a natural drift effect, rather than a fan or other air movement device, by forming the housing to be relatively long, for example, eight feet in length or more.

Figure 18B:
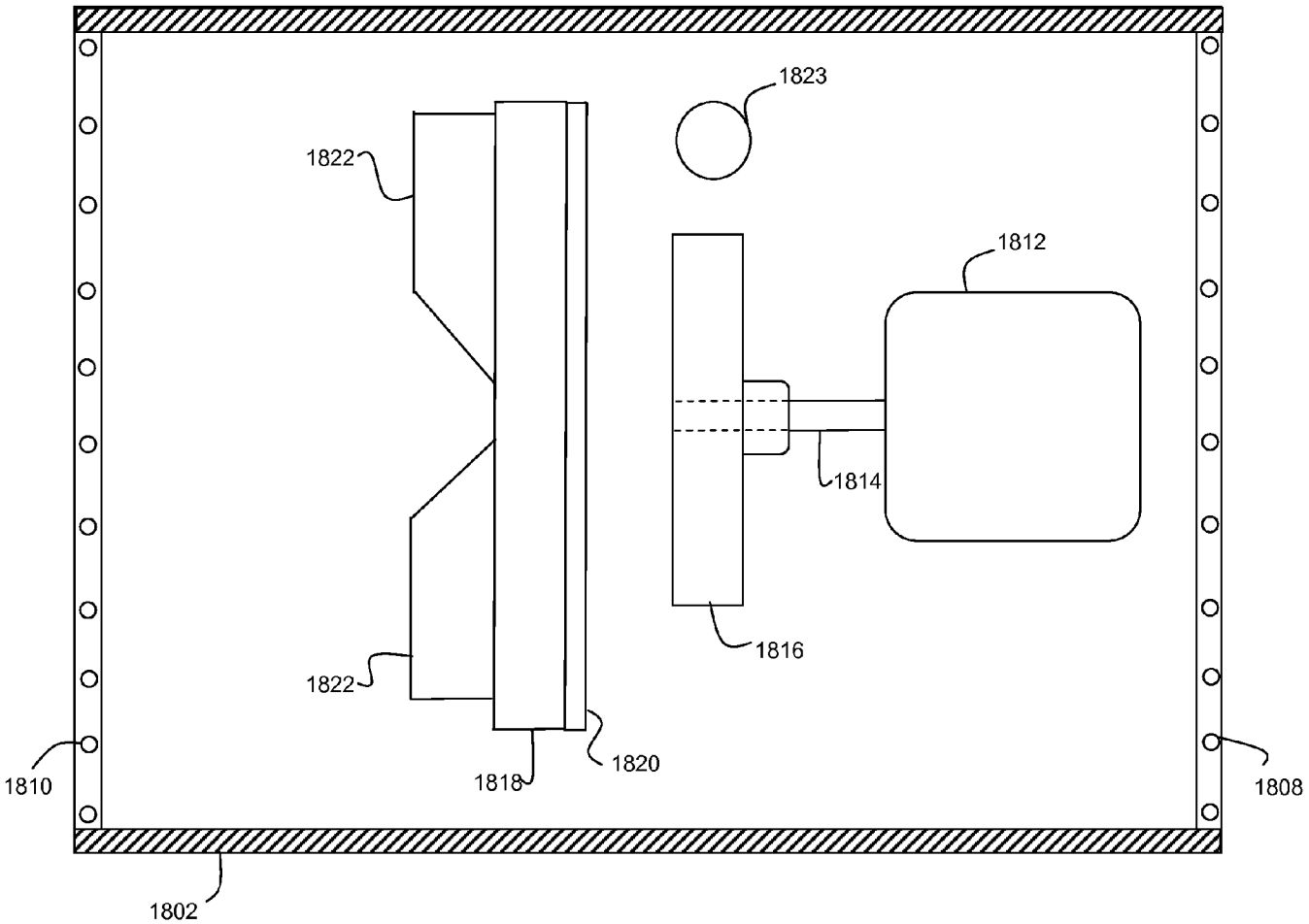
FIG. 18B is an enlarged sectional view of internal components of the fourth embodiment according to an exemplary embodiment.

Referring to FIG. 18B, a motor 1812 is connected to a drive shaft 1814 to drivably rotate a rotor 1816 within the housing 1802. The motor 1812 may be an electric motor, an internal combustion motor, or any other type of motor configured to rotate the drive shaft and thereby rotate the rotor 1816. In another embodiment, the motor 1812 rotates the rotor 1816 using a belt instead of a drive shaft 1814. The rotor 1816 includes a plurality of magnets, which is described below, to create a magnetic field and thereby generate heat.

In some embodiments, the motor 1812 may be a multiple-speed motor, for example, a three-speed motor, or a variable speed motor. An exemplary three-speed motor may have preset speeds, such as 1700 rpm, 3500 rpm, and 5000 rpm. An exemplary variable-speed motor may have a range of speeds, such as 100 rpm to 5000 rpm. If a multiple-speed motor or a variable-speed motor is used, a rotating member may be rotated at varying speeds. Varying the speed of the motor can affect the amount of heat generated. The motor may be configured for a speed setting based on a desired amount of heat, or the speed of the motor may be adjusted, manually or automatically, to vary the heat output. In one embodiment, a thermostat may be coupled to the motor and adjust the motor speed based upon the desired heat output.

The permanent magnet heater 1800 also includes a ferrous disk 1818 and a copper plate 1820 proximately located to the ferrous disk 1818, and for example, the copper plate 1820 may be secured to the ferrous disk 1818 using a fastener (not shown). The ferrous disk 1818 and the copper disk 1820 touch so that heat may be conducted through the copper disk 1820, and in a preferred embodiment, a flat surface of the copper disk 1820 and a flat surface of the ferrous disk 1818 are flush against each other for efficient heat transfer. The copper plate 1820 may be a heat absorber plate, and may comprise any other metal capable of efficiently transferring heat to the air. While the ferrous disk 1818 may comprise any type of ferrous metal, and the amount of iron included in the ferrous metal comprising the ferrous disk 1818 may alter the amount of heat generated by the permanent magnet heater 1800. For example, if the ferrous disk 1818 comprises a steel with a higher concentration of iron, a stronger magnetic field may be created between the ferrous disk 1818 and the magnets included in the rotor 1816, and more heat may be generated. The amount of heat generated also depends on the strength of the magnets included in the rotor 1816, the size of an air gap between the rotor 1816 and the copper plate 1820, and the size of the internal components of the magnet heater 1800.

While FIG. 18B illustrates that the motor drives the rotor 1816, in another embodiment, the motor 1812 may rotate the ferrous disk 1818. In yet another embodiment, a second motor may be included to turn the ferrous disk 1818 while also turning the rotor 1816 in an opposite direction to the rotating direction of the ferrous disk 1818 (for example, the ferrous disk 1818 may rotate clockwise while the rotor 1816 may rotate counter-clockwise). The second motor may also be replaced by a set of gears so that the ferrous disk 1818 rotates in the opposite direction of the rotation of the rotor 1816. Although not illustrated, a non-rotating member, whether it be the rotor 1816 or the ferrous disk 1818, may be secured to the housing 1802 by some supports or shafts extending from the housing 1802 and connecting to the non-rotating member to prevent rotation of the non-rotating member. Such supports of shafts that prevent rotation of the non-rotating member are especially useful if the non-rotating member is supported by the drive shaft 1814 and connected to the drive shaft 1814 with a bearing or the like. The rotor 1816 may be any size in diameter (e.g., six inches, one foot, two feet, six feet) depending on the particular application of the heater 1800. The disk 1818 may also have any corresponding size with the rotor 1816, and the disk 1818 may be formed to any size, such as six inches, one foot, two feet, six, feet, or any side in diameter.

The copper plate 1820 and the ferrous disk 1818 are illustrated as proximate to each other. In one configuration, the copper plate 1820 and the ferrous disk 1818 are secured to each other. If the copper plate 1820 and the ferrous disk 1818 are secured to each other, they may be secured by any of the fastening methods shown in the first through third embodiments, or by any other securing method, such as using an adhesive.

The ferrous disk 1818 may include cooling fins 1822 that may be fastened to or connected to of the ferrous disk 1818. As another example, the cooling fins 1822 may be molded as part of the ferrous disk 1818. In a preferred embodiment, the cooling fins 1822 comprise steel or another ferrous material, but the cooling fins 1822 may also be made of any other material that conducts heat from the ferrous disk 1818. The cooling fins 1822 conduct heat from the ferrous disk 1818 and transfer the heat to the air flowing around the ferrous disk 1818 and the cooling fins 1822. The rotor 1816 may also include cooling fins extending away from the copper plate 1820. The cooling fins 1822 may replace a fan by increasing the surface area of the ferrous disk 1818 to more efficiently transferring heat to the air. Also, the cooling fins 1822 may operate as a fan if the ferrous disk 1818 is rotated by the motor 1812. While a fan has been described as omitted in the fourth embodiment, depending on the application of the magnet heater 1800, a fan may be included.

In one embodiment, an ultraviolet (UV) bulb 1823 may further be included in the housing 1802. The UV bulb can kill airborne bacteria in the air that enters the housing 1802. Although the exemplary embodiment recites a UV bulb, any other devices or materials for eliminating airborne bacteria can be included in the housing 1802, such as those that emit light, gas, or fluids.

Figure 18C:
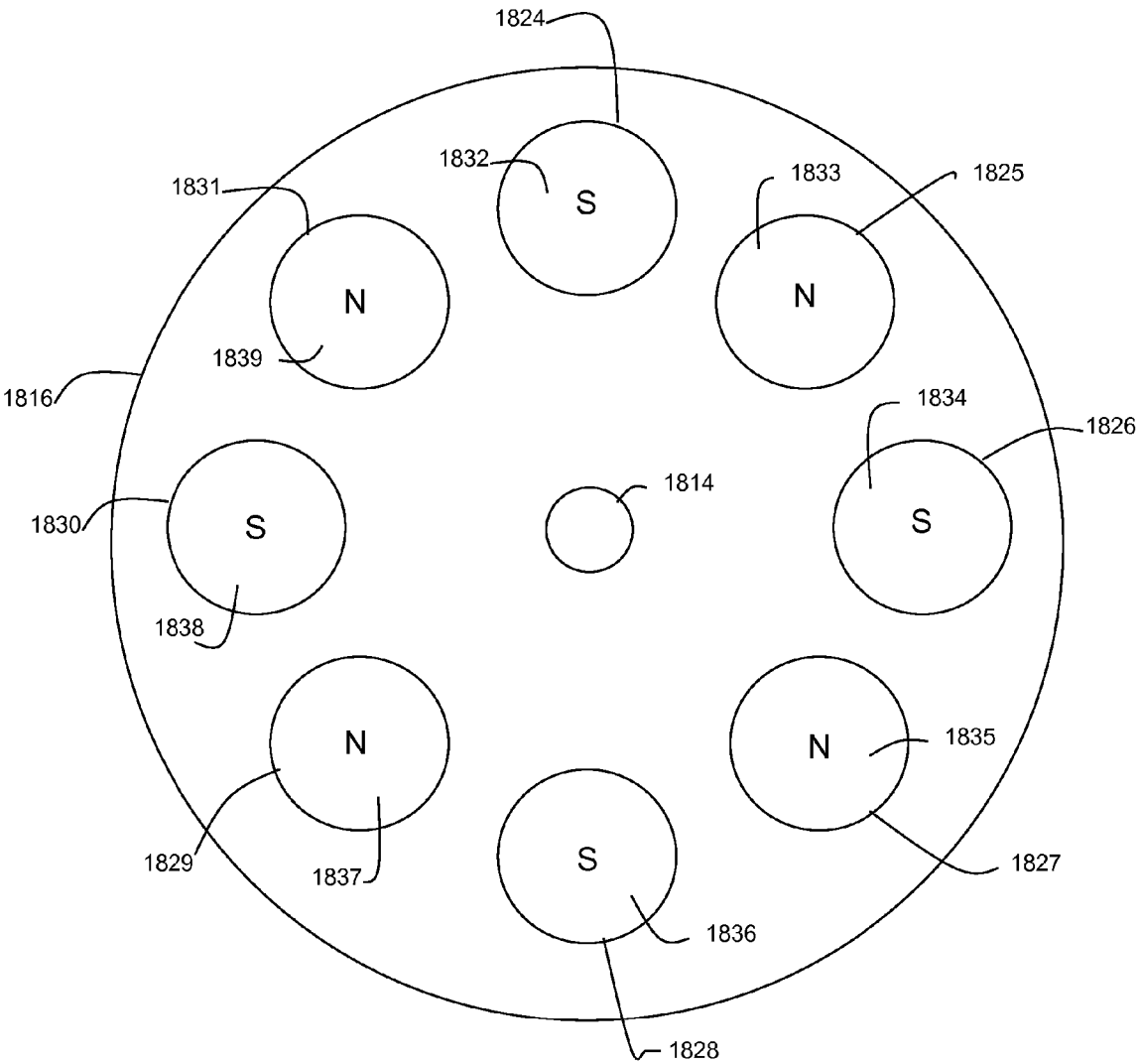
FIG. 18C is a front view of a rotor member including permanent magnets according to an exemplary embodiment.

Referring to FIG. 18C, the rotor 1816 includes a plurality of cylindrical bores 1824-1831 arranged in an annular configuration around the rotor 1816. The bores 1824-1831 may have a uniform diameter and extend all the way through the rotor 1816. Permanent magnets 1832-1839, which may be neodymium magnets or any other type of permanent magnet, have a cylindrical shape, and have outer walls engage with inside walls of the bores 1824-1831. Each of the plurality of magnets 1832-1839 is adjacent to at least one of the plurality of magnets 1832-1839 of opposite polarity, as illustrated by N and S in FIG. 18C. The permanent magnets 1832-1839 are enclosed within the bores 1824-1831 of the rotor 1816. While eight magnets are illustrated in FIG. 18C, the number of magnets may be increased or decreased, and the arrangement of the magnets may also vary. For example, if the magnet heater 1800 is used for crop drying, the size of the rotor 1816 according to the fourth embodiment may be larger than the rotor of the first through third embodiments. If the rotor 1816 according to the fourth embodiment is used for crop drying, additional magnets or larger and stronger magnets may be included on the rotor 1816. Further, more than one annular configuration of magnets may be included on the rotor 1816, and a second annular configuration may be included within the annular configuration of permanent magnets 1832-1839 illustrated in FIG. 18C. If the size of the rotor 1816 is increased, other components, such as the copper disk 1820 and the ferrous disk 1818, may be increased accordingly.

Figure 18D:
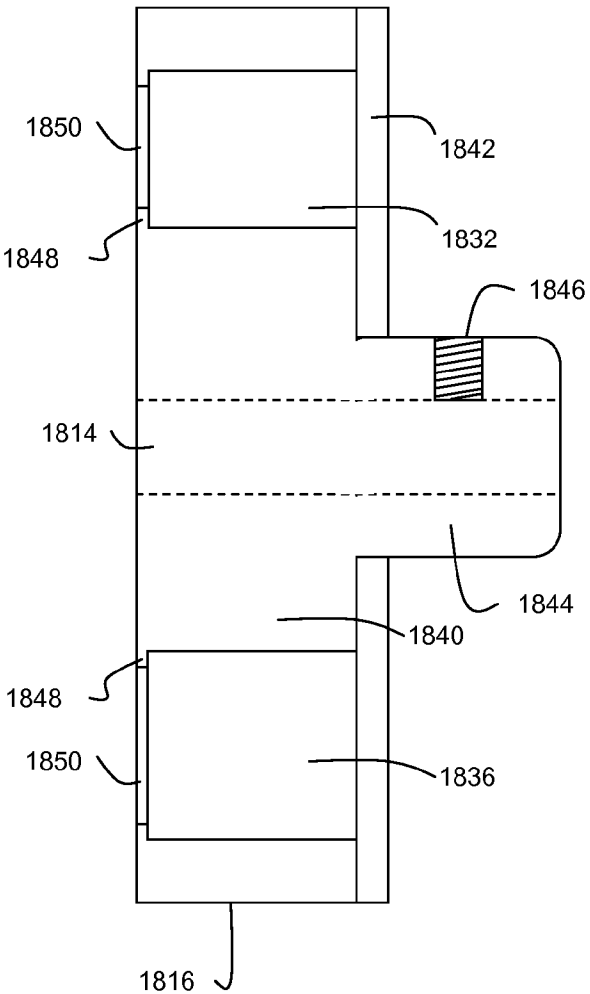
FIG. 18D is a side view of the rotor member including permanent magnets according to an exemplary embodiment.

Referring now to FIG. 18D, a side view of the rotor 1816 is illustrated. The rotor comprises a disk 1840, a plate, 1842, and a hub 1844. The disk 1840 may comprise a non-ferrous material, such as aluminum, and the disk 1840 may be secured to the plate 1842 with a fastener (not shown). The plate 1842 may also comprise a non-ferrous material such as aluminum. The disk 1840 includes the hub 1844 where the rotor 1816 is connected to the drive shaft 1814 with a fastener 1846, such as a screw or bolt, so that the rotor 1816 rotates with the rotation of the drive shaft 1814. If the rotor 1816 does not rotate, and the ferrous disk 1818 rotates, the fastener 1846 may connect the hub 1844 to a bearing or some other device that allows the drive shaft 1814 to rotate without rotating the disk 1840.

Permanent magnets 1832 and 2012 are shown along this perspective. The permanent magnets 1832-1839 are held within bores 1824-1831, which extend through the disk 1840, and the magnets 1832-1839 may be retained in the bores 1824-1831 by flanges 1848. Between the flanges 1848, coatings 1850, such as glass, plastic, or rubber members, may cover the magnets 1832-1839. The permanent magnets 1832-1839 may also be held in the bores 1824-1831 by the plate 1842 on the opposite side of the permanent magnets 1832-1839 as the flanges 1848.

Figure 18E:
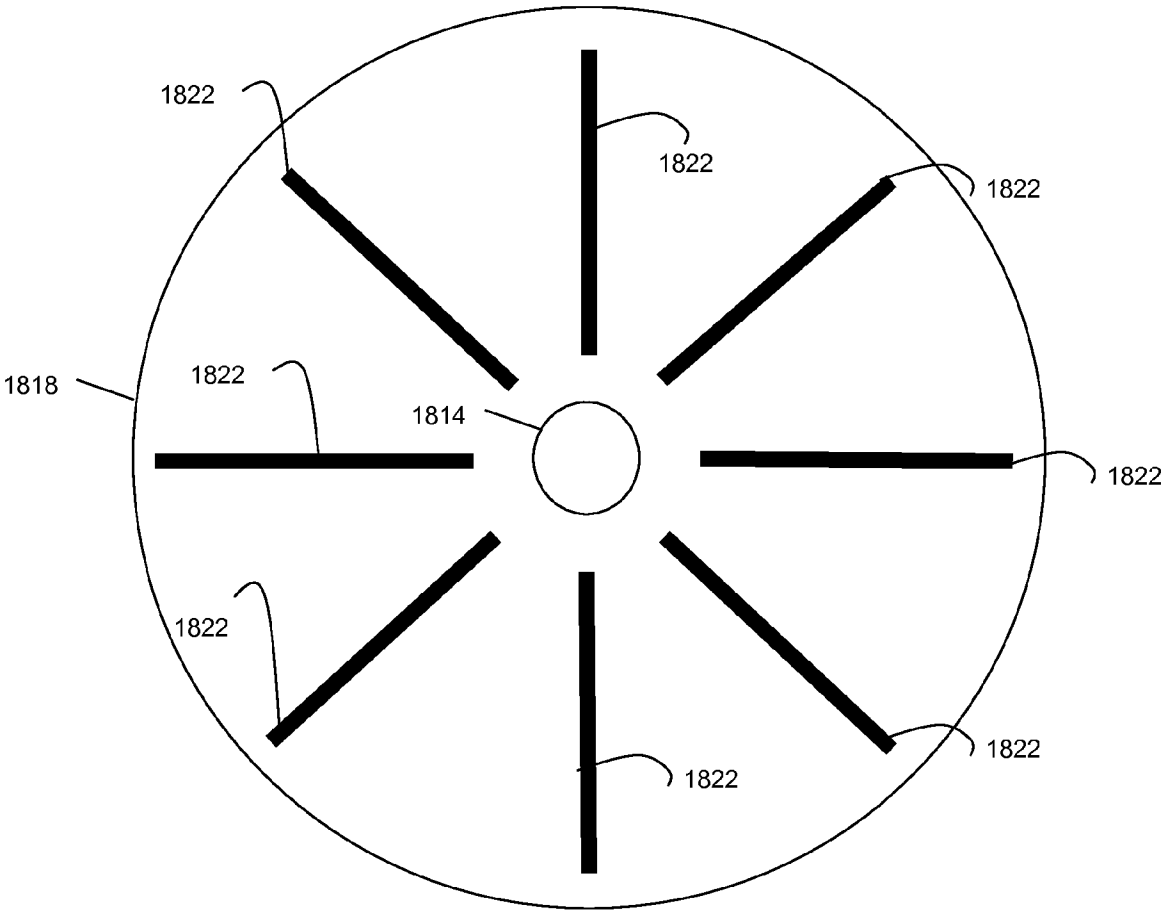
FIG. 18E is a front view of a steel member including a plurality of cooling fins according to an exemplary embodiment.
Figure 18F:
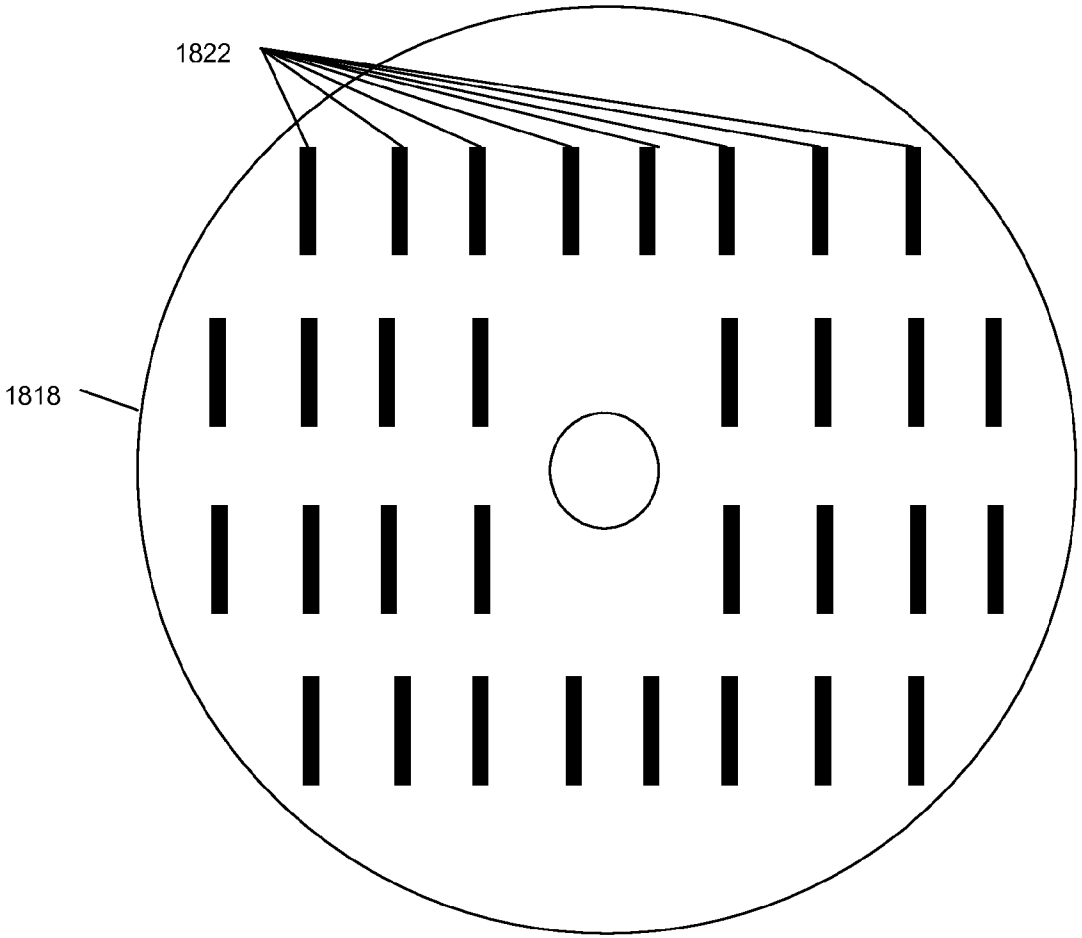
FIG. 18F is another front view of the steel member including the plurality of cooling fins according to an exemplary embodiment.

Referring to FIGS. 18E and 18F, two different exemplary configurations of the ferrous disk 1818 and cooling fins 1822 are illustrated in detail. First, in FIG. 18E, the cooling fins 1822 are illustrated as extending outward in different directions from the drive shaft 1814, which may be located in the center of the ferrous disk 1818. Eight cooling fins 1822 are illustrated in this configuration, but more or fewer cooling fins 1822 may be placed along the ferrous disk 1818 consistent with the configuration shown in FIG. 18E. The second configuration, shown in FIG. 18F, includes many cooling fins 1822 scattered on the ferrous disk 1818. The cooling fins 1822 according to the second configuration of FIG. 18F may be placed in lines and/or patterns or in a configuration lacking any order. Further, while the ferrous disk 1818 is illustrated as circular, the steel disk 1818 may be formed in any shape, such as a square, rectangle, oval, or any other shape, but the circular shape is a preferred embodiment because of the rotation generated by the motor 1812.

As the rotor 1816 rotates adjacent to the ferrous disk 1818, magnetic fields are created, and the magnetic forces between the magnets 1832-1839 and the ferrous disk 1818 generates heat, thereby increasing the temperature of the copper plate 1820. Some of the heat from the copper plate 1820 is transferred to the air inside the housing 1802. The heated air rises out of the housing 1802 through the second opening 1806 to dry produce proximally located to the permanent magnet heater 1800.

Figure 18G:
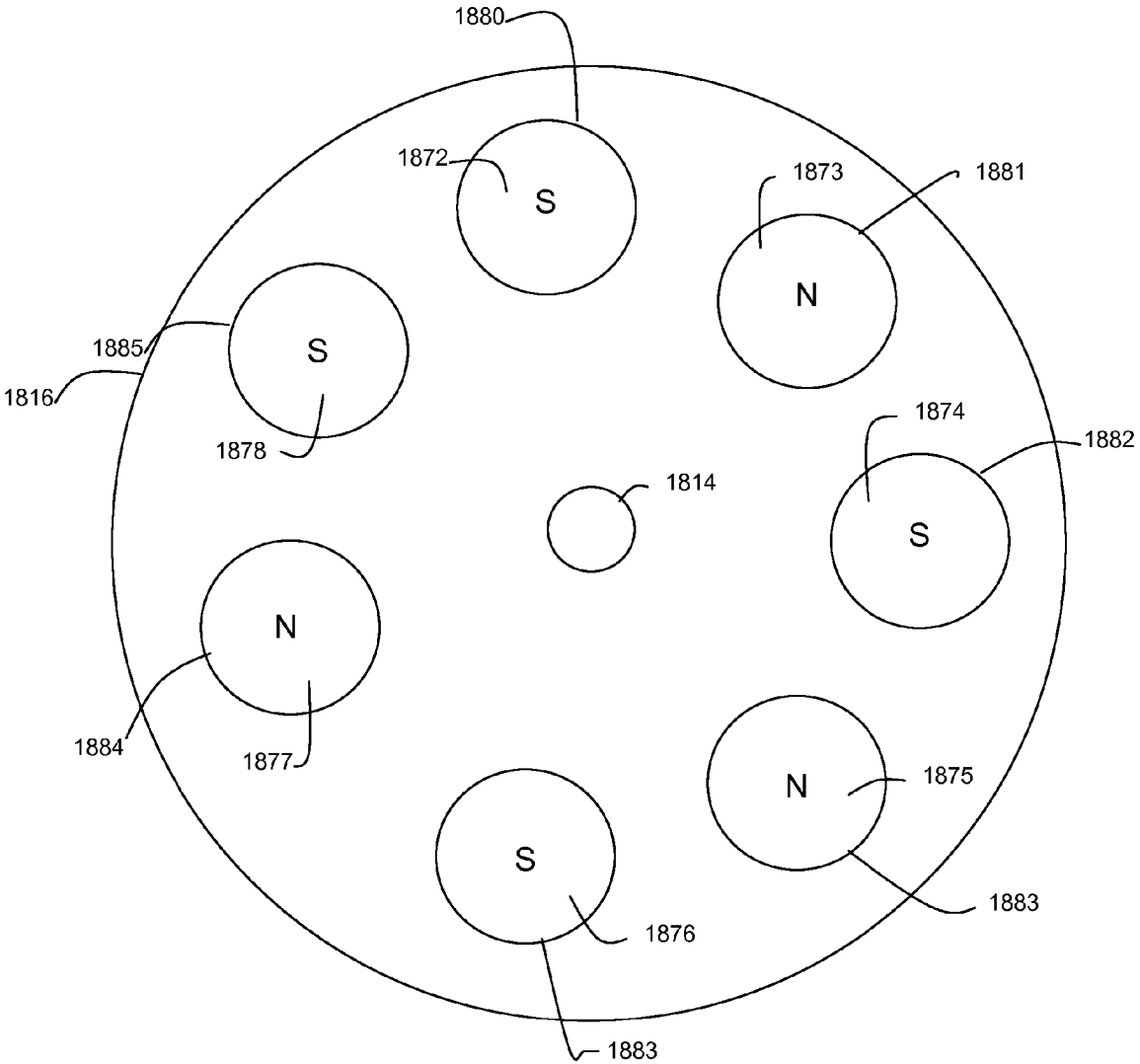
FIG. 18G is a front view of another configuration of a rotor member including permanent magnets according to an exemplary embodiment.

FIG. 18C illustrates an even number of magnets of alternative polarity (e.g., north-south-north-south). However, some embodiments may have an odd number of magnets or a configuration where two adjacent magnets have the same polarity (e.g., north-south-south-north-south). FIG. 18G illustrates a configuration of the magnets 1872-1878 in the bores 1880-1885 arranged on the rotor 1816. In the odd numbered configuration of magnets, two adjacent magnets of the plurality of magnets will have the same polarity, as illustrated by magnets 1878 and 1872 both having a south polarity (S). The odd-numbered configuration can generate heat and may affect sound emission of the permanent magnet heater 1800.

Figure 19A:
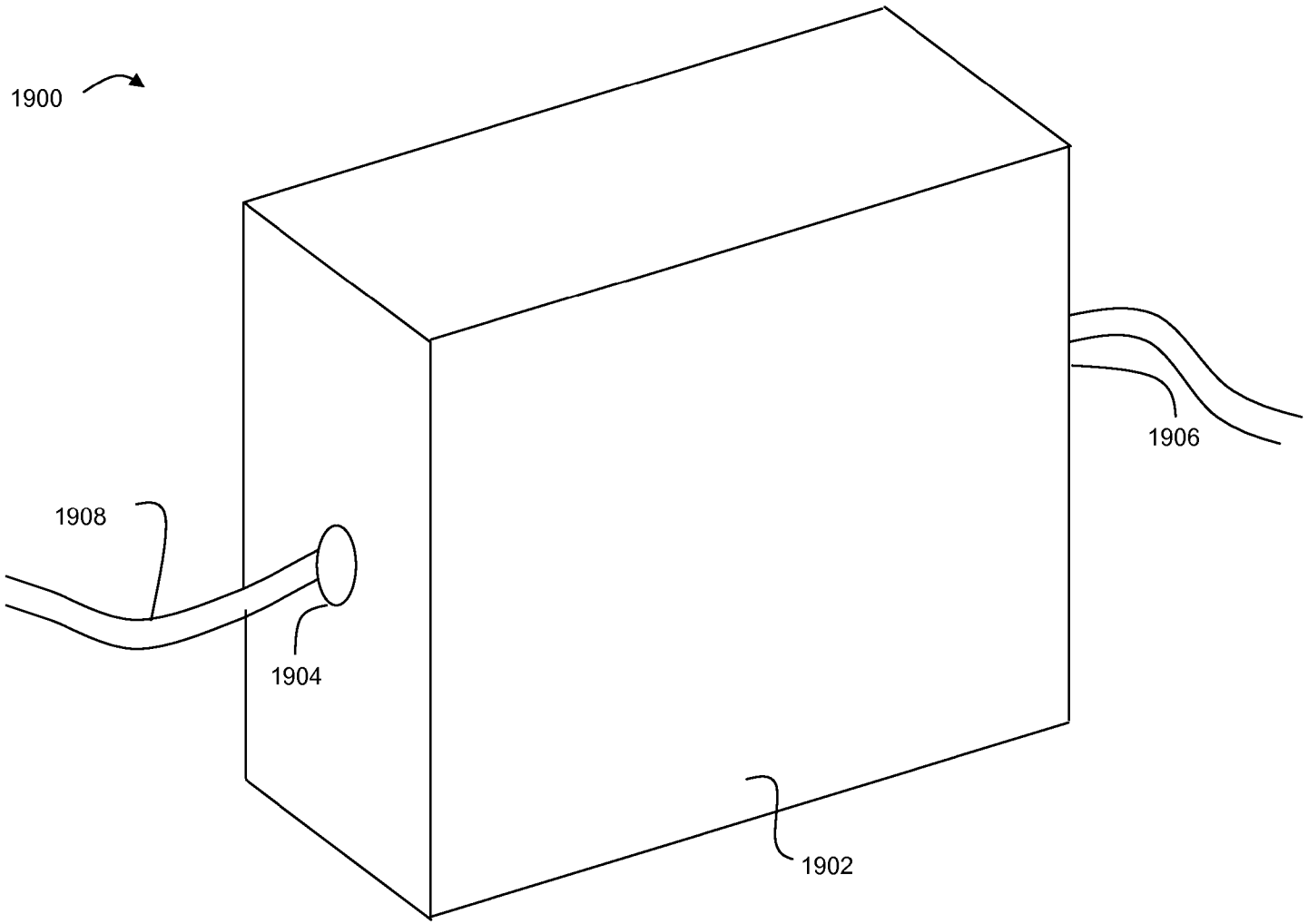
FIG. 19A is a perspective view of a fifth embodiment of a permanent magnet fluid heater of the exemplary embodiments according to an exemplary embodiment.

A fifth embodiment of a magnet heater 1900 is illustrated in FIGS. 19A-19E. The fifth, sixth, and seventh embodiments of the magnet heater 1900 may be applied to heating fluids, including liquids. Referring to FIG. 19A, a housing 1902 of the magnet heater 1900 is illustrated. The housing 1902 has a first opening 1904 and a second opening 1906 located on opposite sides of the housing 1902. The housing 1902 is illustrated as having a box configuration, however the housing 1902 may take a variety of different configurations such as a cylindrical configuration, spherical configuration, ornamental configuration or any other configuration that is capable of housing the components of the magnet heater 1900. Because the magnet heater 1900 may be used to heat liquids, a tube 1908, which may be a hose, may be included to input the liquid into the magnet heater 1900, although the liquid may be inputted into the magnet heater 1900 through any method or any component. For example, the tube 1908 may be omitted and the fluid may enter the housing 1902 through first opening 1904. Additional elements, such as a pump (not illustrated), may be included to input the fluid into the housing 1902. Additionally, the pump may be omitted if gravity or pressure differences is used to input fluid into the housing 1902. For example, if the permanent magnet heater 1900 is implemented in a swimming pool, the permanent magnet heater 1900 may use an existing filtration system to receive fluid into the heater 1900.

Figure 19B:
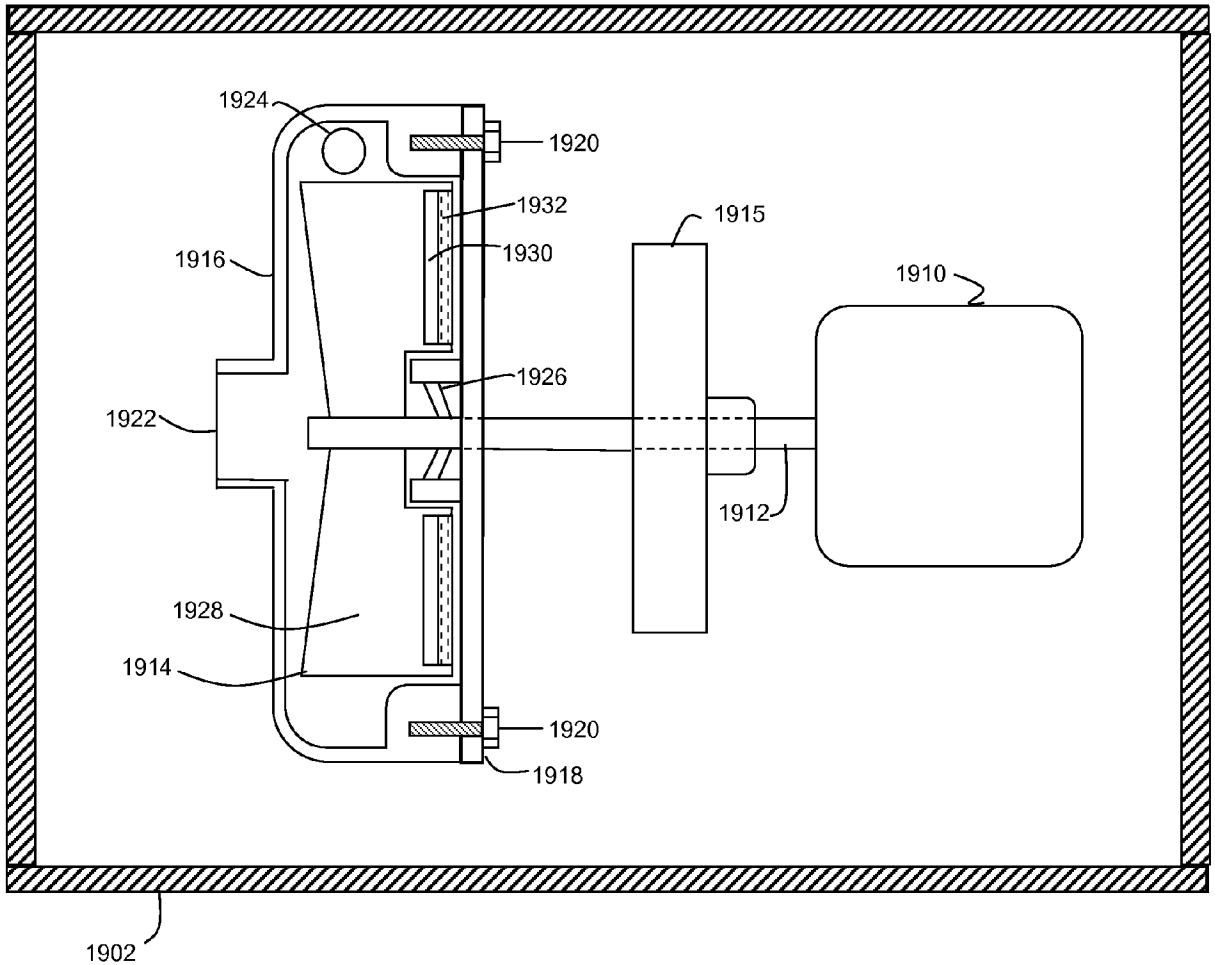
FIG. 19B is an enlarged sectional view of internal components of the fifth embodiment according to an exemplary embodiment.

Referring to FIG. 19B, a motor 1910 is connected to a drive shaft 1912 to drivably rotate an rotor 1914 within a heating housing 1916. The motor 1910 may be an electric motor, an internal combustion motor, or any other type of motor configured to rotate the drive shaft 1912 and thereby rotate the rotor 1914.

The drive shaft 1912 passes through and supports a non-ferrous magnet assembly 1915, but the non-ferrous magnet assembly 1915 does not rotate with the rotation of the drive shaft 1912. The non-ferrous magnet assembly will be described in further detail with reference to FIG. 19E.

The drive shaft 1912 rotates to rotate the rotor 1914 within the heating housing 1916, but the heating housing 1916 does not rotate. The heating housing 1916 may comprise die cast aluminum or high temperature plastic and is fastened to a disk 1918, which may comprise aluminum or another non-magnetic material, using fasteners 1920. The heating housing 1916 further includes an inlet 1922, where liquid enters the heating housing 1916, and an outlet 192,4 where liquid is pushed out of the heating housing 1916 by the rotation of the rotor 1914. The fluid may be pushed through the outlet 1924 by centrifugal force created by spinning the rotor 1914 within the heating housing 1916. While the outlet 1924 is illustrated as located near the top of the heating housing 1916, the outlet 1924 may be positioned at any position on the heating housing 1916, including the bottom or mid-sections of the housing. Further, the heating housing 1916 may include a shaft seal 1926 positioned around the drive shaft 1912 to prevent any liquid from escaping through an opening in the heating housing 1916 for receiving the drive shaft 1912. The seal 1926 may be formed of rubber, sealant, or any other material useful in preventing the passage of liquid through the opening.

The rotor 1914 includes aluminum fins 1928, a ferrous plate, 1930, and a copper plate 1932. The fins 1928 may extend through the entire diameter of the heating housing 1916 to pump heated liquid out of the heating housing 1916 through the outlet 1924. The ferrous plate 1930 and the copper plate 1932 rotate relative to the non-ferrous magnet assembly 1915, which includes a plurality of magnets, with the movement of the drive shaft 1912. In other words, the ferrous plate 1930 and the copper plate 1932 rotate with the movement of the fins 1928, and all components of the rotor 1914 rotate together. The ferrous plate 1930 may be a steel plate or a cast iron plate of varying concentrations of iron, and the strength of the magnetic field created between the magnets and the ferrous plate 1930 depends on the concentration of iron in the ferrous plate 1930, thereby affecting the amount of heat created within the heating housing 1916. In addition to the density of the iron in the ferrous plate 1930, the thickness of the copper plate 1932 may affect the strength of the magnetic field, and thereby, the amount of heat generated by the magnet heater 1900.

Figure 19C:
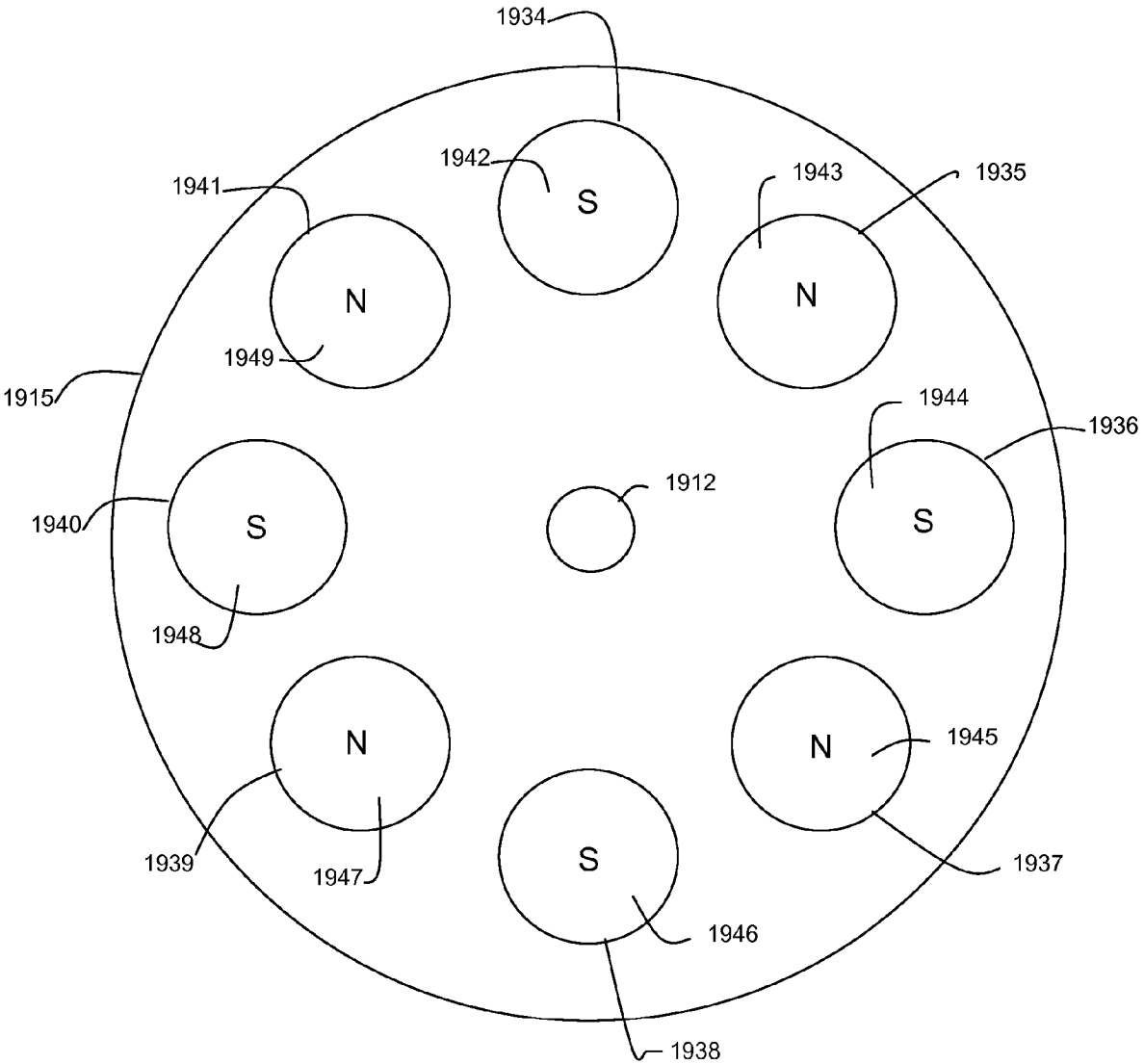
FIG. 19C is a front view of a rotor member including permanent magnets according to an exemplary embodiment.

Referring to FIG. 19C, the non-ferrous magnet assembly 1915 includes a plurality of cylindrical bores 1934-1941 arranged in an annular configuration around the non-ferrous magnet assembly 1915 toward the circumference of the non-ferrous magnet assembly 1915. The bores 1934-1941 may have a uniform diameter and extend through the non-ferrous magnet assembly 1915. Permanent magnets 1942-1949, which may be neodymium magnets, may have a cylindrical shape and have outer walls engaged with inside walls of the bores 1934-1941. Each magnet is adjacent magnet of opposite polarity, as illustrated by N and S in FIG. 18C. The permanent magnets 1942-1949 are enclosed within the bores 1934-1941 of the non-ferrous magnet assembly 1915. While eight magnets are illustrated in FIG. 19C, the number of magnets may be increased or decreased. Further, more than one annular configurations of magnets may be included on the non-ferrous magnet assembly 1915 within the annular configuration of permanent magnets 1942-1949 illustrated in FIG. 18C.

Figure 19D:
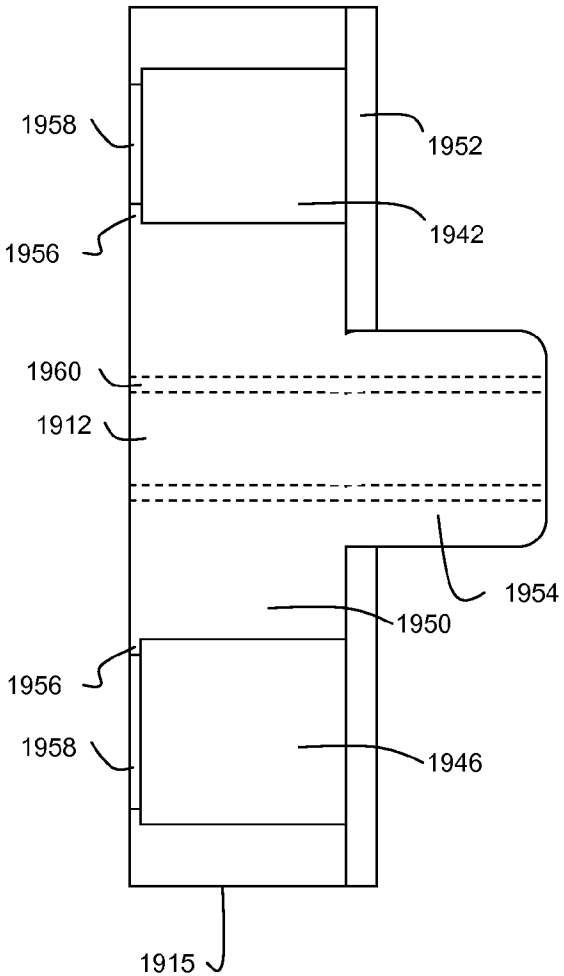
FIG. 19D is a side view of the rotor member including permanent magnets according to an exemplary embodiment.

Referring now to FIG. 19D, a side view of the non-ferrous magnet assembly 1915 is illustrated. The non-ferrous magnet assembly 1915 comprises a disk 1950, a plate, 1952, and a hub 1954. The disk 1950 may comprise a non-ferrous material, such as aluminum, and the disk 1950, which may also comprise a non-ferrous material such as aluminum, may be secured to the plate 1952 around the hub 1954 with a fastener (not shown). The disk 1950 includes a hub 1954 where the non-ferrous magnet assembly 1915 is connected to the drive shaft 1912.

Permanent magnets 1942 and 1946 are shown along this perspective. The permanent magnets 1942-1949 are held within bores 1934-1941, which extend through the disk 1950, and the magnets 1942-1949 may be retained in the bores 1934-1941 by flanges 1956. Between the flanges 1956, coatings 1958, such as glass, plastic, or rubber members, may cover the magnets 1942-1949.

The non-ferrous magnet assembly 1915 may include a bearing 1960. The bearing 1960 allows the drive shaft 1912 to rotate while the non-ferrous magnet assembly 1915 remains stationary. The non-ferrous magnet assembly 1915 may further be secured to the housing 1902 to prevent the non-ferrous magnet assembly 1915 from rotating with the rotation of the shaft. The heating housing 1916 may also include a bearing that prevents it from rotating with the rotation of the drive shaft 1912. Further, although not illustrated, the heating housing 1916 and the non-ferrous magnet assembly 1915 may be secured to the housing 1902 or the motor 1910 to prevent rotation.

Figure 19E:
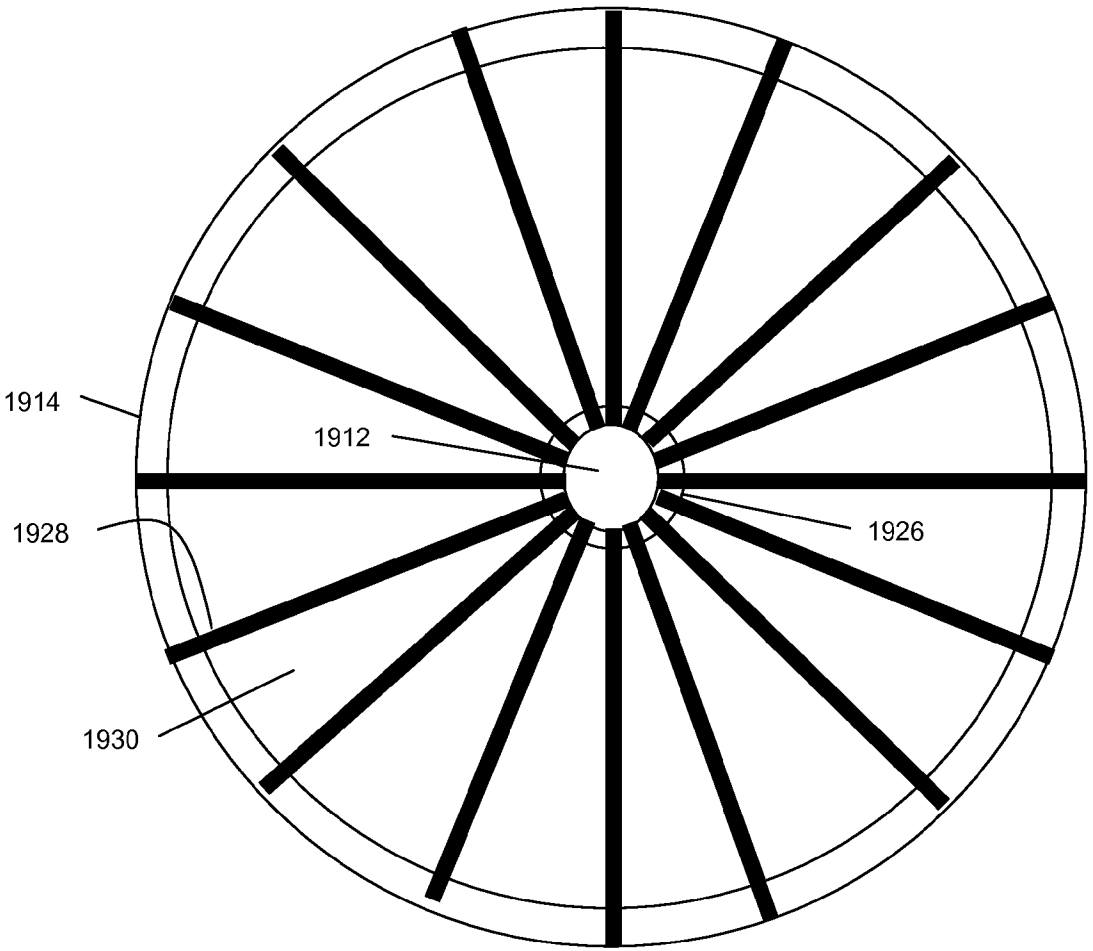
FIG. 19E is a front view of a steel member according to an exemplary embodiment.

Referring to FIG. 19E, a front view of the rotor 1914 is illustrated. As shown in FIG. 19E, the plurality of fins 1928 extend in different directions away from the drive shaft 1912. The plurality of fins 1928 may be connected to the drive shaft 1912 so that the plurality of fins 1928 rotates with the rotation of the drive shaft 1912. The fins 1928 may also be fixed or secured to the ferrous plate 1930 so that the ferrous plate 1930 and the copper plate 1932, which is secured to the iron plate 1930, also rotate with the rotation of the fins 1928 and the drive shaft 1912. The number of fins 1928 may vary depending on the size of the heating housing 1916, the amount of fluid inputted into the heating housing 1916, the speed of the motor 1910, and other factors, and more or fewer fins 1928 may be included in the rotor 1914. The fins 1928 may comprise aluminum or another non-ferrous metal. While not illustrated, the ferrous plate 1930 may be sealed so that no fluid actually touches the ferrous plate 1930. By sealing the ferrous plate 1930, the ferrous plate 1930 may be protected from corrosion and rust.

As the rotor 1914 rotates adjacent to the non-ferrous magnet assembly 1915, magnetic fields are created, and the magnetic forces between the magnets and the iron disk 1930 generates heat, thereby increasing the temperature of the copper plate 1932. Some of the heat from the copper plate 1932 is transferred to the fluid inside the heating housing 1916. The fluid is moved through the heating housing 1916 as the fins 1928 rotate within the heating housing 1916, and the heated fluid is pushed out the outlet 1924 through pressure and centrifugal force.

Figure 20:
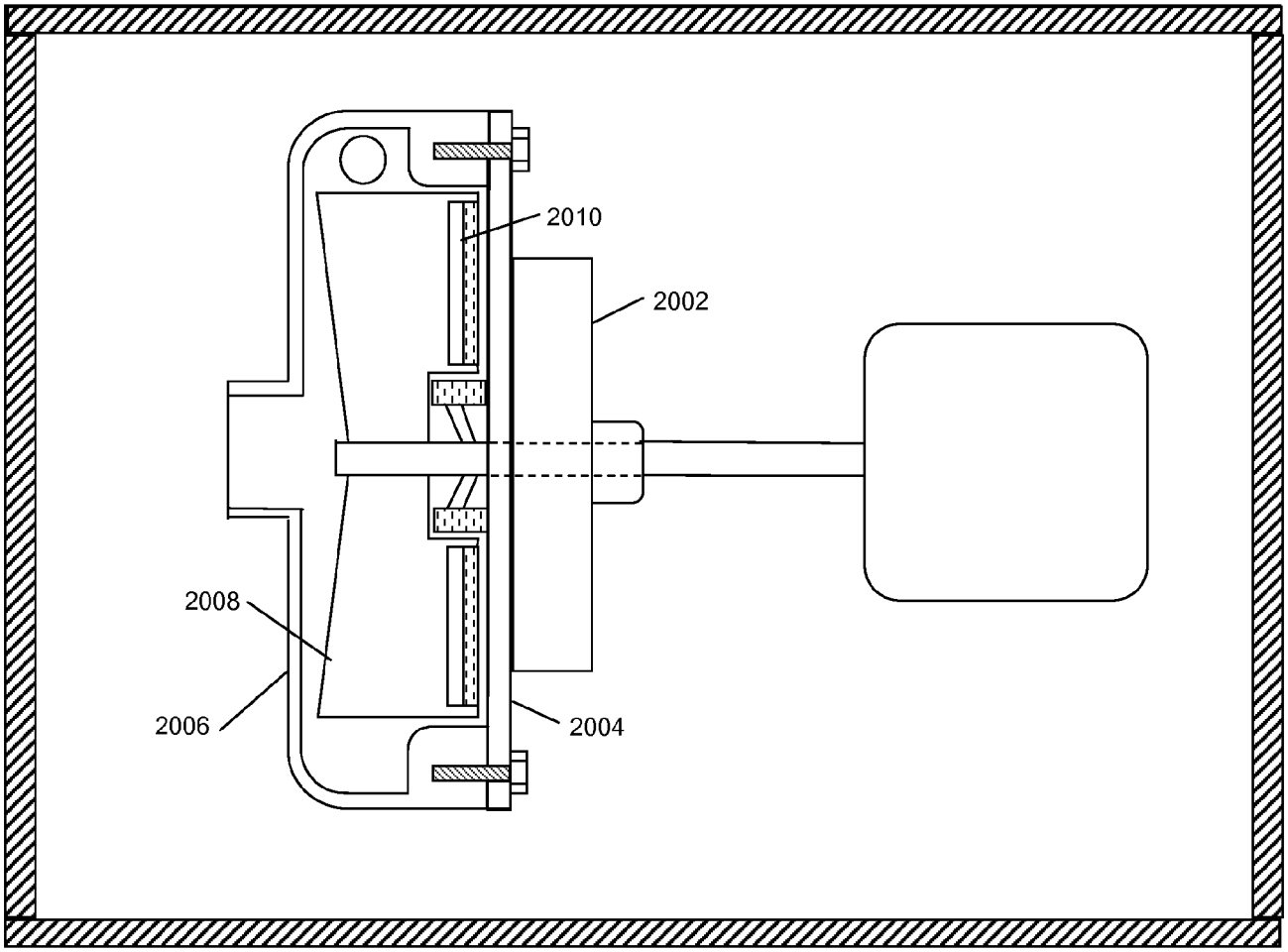
FIG. 20 is an enlarged sectional view of another configuration of the fifth embodiment according to an exemplary embodiment.

The fifth embodiment of the magnet heater 1900 may be modified in the configuration illustrated in FIG. 20. As shown in FIG. 20, a non-ferrous magnet assembly 2002 may be secured to a disk 2004 of a heating housing 2006. A rotor 2008 rotates inside the heating housing 2006 in the same way as illustrated in FIGS. 19A-19E. By securing the non-ferrous magnet assembly 2002 to the heating housing 2006, larger magnetic fields may be created because the magnets in the non-ferrous magnet assembly 2002 are located closer to the iron plate 2010 of the rotor 2008, and the stronger magnetic fields generate more heat within the heating housing 2006. All other components are the same as the fifth embodiment illustrated in FIGS. 19A-19E, and further discussion of those components will be omitted.

Figure 21A:
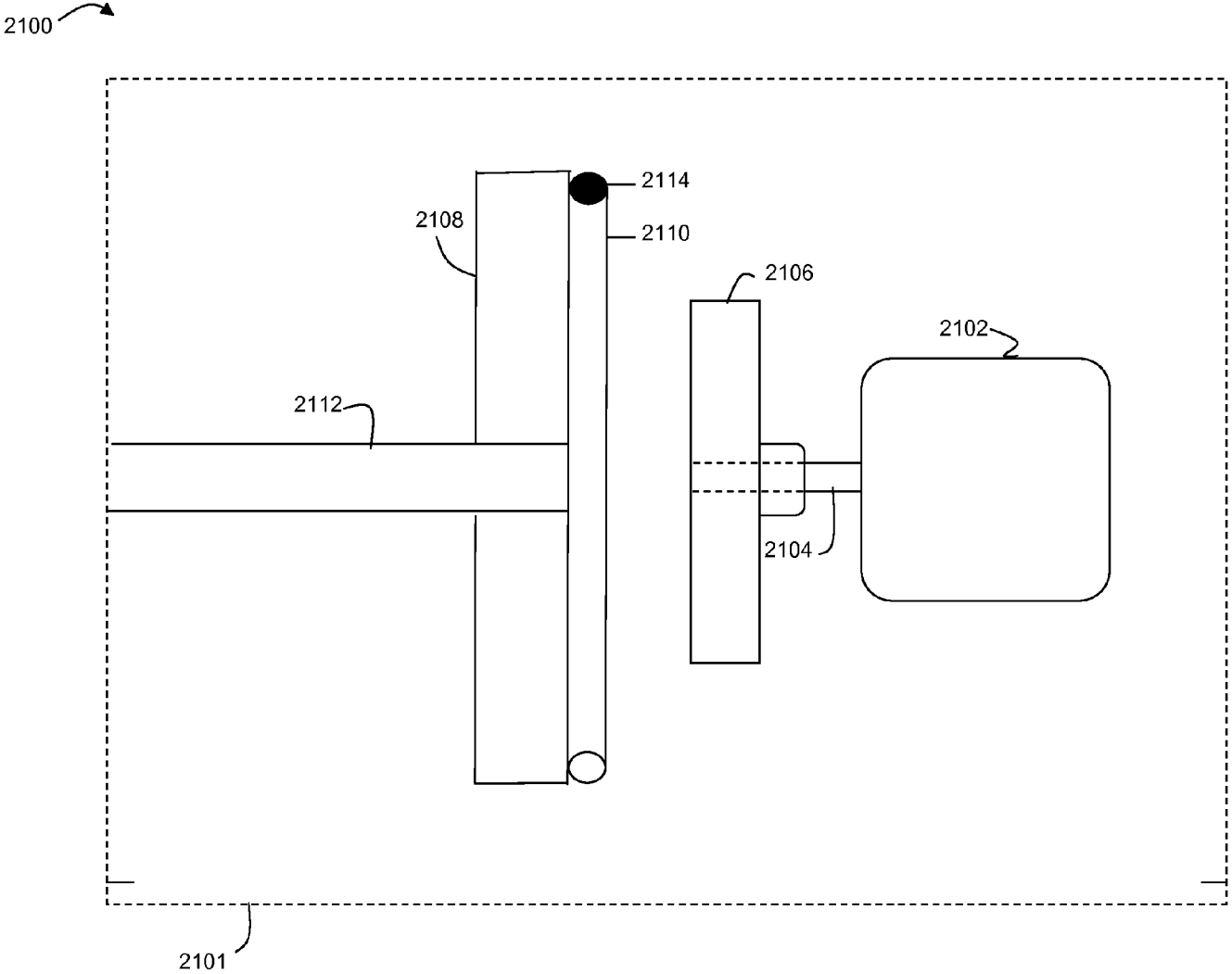
FIG. 21A is an enlarged sectional view of internal components of a sixth embodiment according to an exemplary embodiment.
Figure 21B:
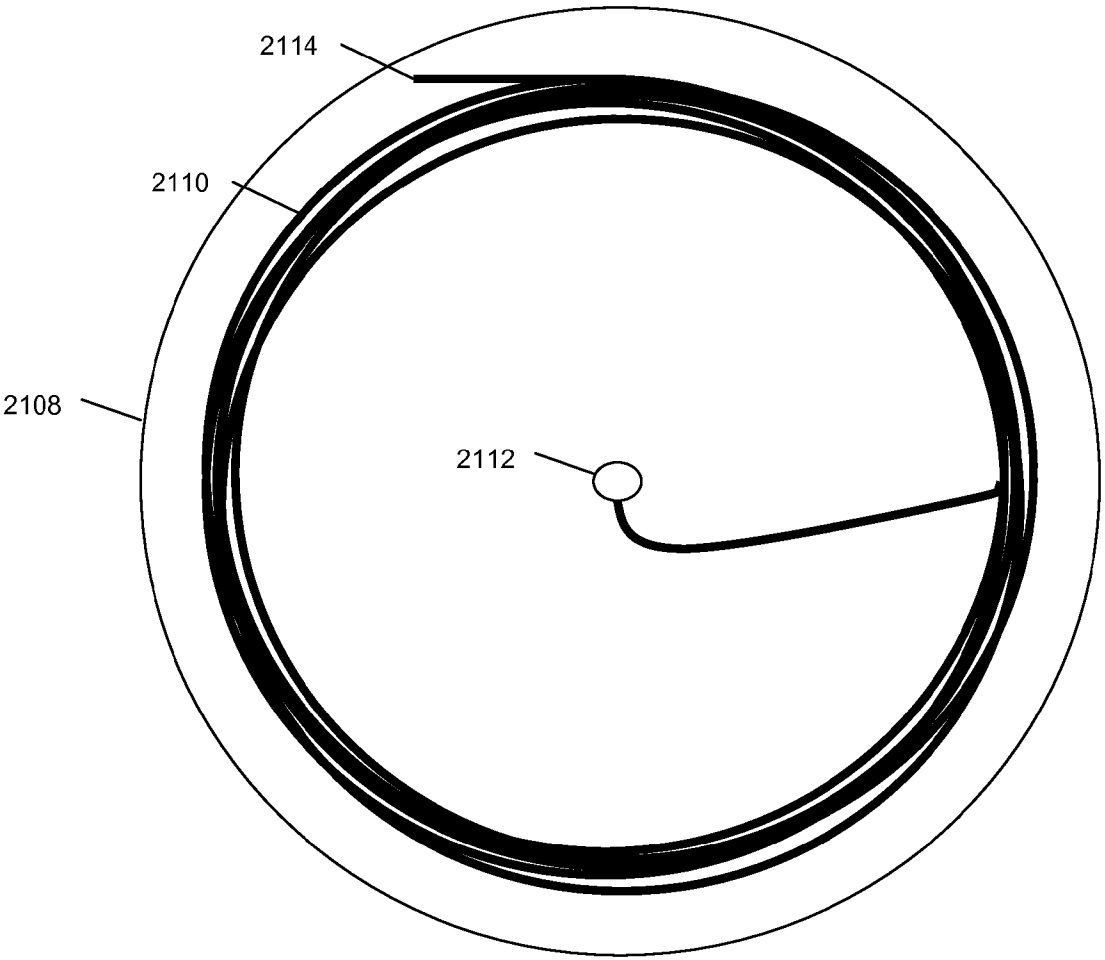
FIG. 21B is a front view of a steel member including a copper coil according to an exemplary embodiment.

A sixth embodiment of a magnet heater 2100 is illustrated in FIGS. 21A and 21B. Like the fifth embodiment, the sixth embodiment of the magnet heater 2100 may be applied to heating fluids, including liquids. A housing 2101 for the sixth embodiment may be substantially similar to the housing in the fifth embodiment, illustrated in FIG. 21A, or the housing may be similar to any of the housings described by the first through fifth embodiment. For example, the housing 2101 may have a box configuration, or a variety of different configurations such as a cylindrical configuration, spherical configuration, or any other configuration that is capable of housing the components of the magnet heater 2100. Because the magnet heater 2100 may be used to heat liquids, a hose may be included to input the liquid into the magnet heater 2100, but the liquid may be inputted into the magnet heater 2100 through any method or any component.

Referring to FIG. 21A, a motor 2102 is connected to a drive shaft 2104 to drivably rotate an rotor 2106 within the housing 2101. The motor 2102 may be an electric motor, an internal combustion motor, or any other type of motor configured to rotate the drive shaft and thereby rotate the rotor 2106. The motor 2102 may also be configured to rotate the rotor 2106 using a belt instead of a drive shaft 2104, but the drive shaft 2104 will be described hereafter for illustration purposes.

Proximate to the rotor 2106, a ferrous plate 2108, which may comprise cast iron or steel, is included within the housing 2101. For example, the ferrous plate 2108 and the rotor 2106 may be substantially parallel to each other. The ferrous plate 2108 may be secured to or positioned next to a copper tubing 2110. Fluid runs through the copper tubing 2110. The fluid enters the copper tubing 2110 through an inlet 2112 and exits the copper tubing 2110 through the outlet 2114.

The rotor 2106 may be a substantially similar rotor as the rotor of the first through fourth embodiment (for example see FIGS. 18C and 18D). More specifically, a plurality of magnets, where each magnet is adjacent, along an annular direction, to a magnet having an opposite polarity, are positioned in bores of the rotor 2106.

Referring to FIG. 21B, the copper tubing 2110 may have a coil configuration and is proximate to the ferrous plate 2108. The copper tubing 2110 and the ferrous plate 2108 may be secured to each other with bolts, or clips or any other method so that the copper tubing 2110 and the ferrous plate 2108 are touching. The copper tubing 2110 may be wound in an annular configuration on the ferrous plate 2108, and the number of windings may vary. For example, the copper tubing 2110 may not have even one full winding around the circumference of the ferrous plate 2108, or the copper tubing 2110 may be would a plurality of times. The number of windings of the copper tubing 2110 may depend on a number of factors, such as the size of the ferrous plate 2108, the strength of the plurality of magnets, the thickness of the copper tubing 2110, distance from the rotor 2106, among other factors. For example, the copper tubing 2110 may have more windings if the magnetic field is weaker, and as a result, less heat is generated in the copper tubing 2110. More windings, in this example, forces the fluid traveling through the copper tubing 2110 to circulate for a longer period of time, and thus, more heat is transferred to the fluid circulating through the copper tubing 2110. While illustrated in a coil configuration, the copper tubing 2110 may also have a spiral configuration, a semi-circle configuration, or even a straight line. The configuration of the copper coil 2110 may depend on the same factors listed above when describing the number of windings of the copper coil 2110.

As the rotor 2106 rotates, a magnetic field is created between the ferrous disk 2108 and the magnets included in the rotor 2106. The magnetic forces between the magnets and the ferrous disk 2108 generate heat in the copper tubing 2110, and the generated heat of the copper tubing 2110 is transferred to the fluid running through the copper coil.

Further, due to the magnetic forces between the permanent magnets and the ferrous disk 2108, as long as the rotor 2106 rotates in the same direction that the copper tubing 2110 is coiled, the magnetic force can assist in pumping the liquid within the copper tubing 2110. These forces are insufficient for a full pumping action, so a pump (not illustrated) may be included, and the pump pumps fluid through the copper tubing 2110 to the outlet 2114.

The magnet heater 2100 according to the sixth embodiment may also be used in a refrigeration system using the known techniques of an absorption refrigerator. In an absorption refrigerator, a heat generator, a separator, a condenser, an evaporator, and an absorber perform a continuous cycle of refrigeration. The heat generator applies heat to a refrigerant solution, which may be ammonia dissolved in water. The refrigerant, such as ammonia, boils from the solution and flows into the separator to be separated from the water. The ammonia gas flows upwards into a condenser, which dissipates heat, and the ammonia converts back into a liquid. After the ammonia is condensed into a liquid it enters an evaporator, and the ammonia evaporates at a very low boiling point, which produces cold temperatures. After evaporating, the ammonia gas is absorbed into the water to create the solution once again, and the cycle is repeated. The magnet heater 2100 is capable of replacing the heat generator of the absorption refrigerator, but a separator, condenser, evaporator, and absorber would need to be connected to the magnet heater 2100 to form the full refrigeration cycle. By replacing a conventional heat generator, which may burn gasoline, propane, or kerosene, with the magnet heat generator 2100, less energy is used and no carbon emissions are created by the absorption refrigerator that includes the magnet heat generator 2100.

Figure 22:
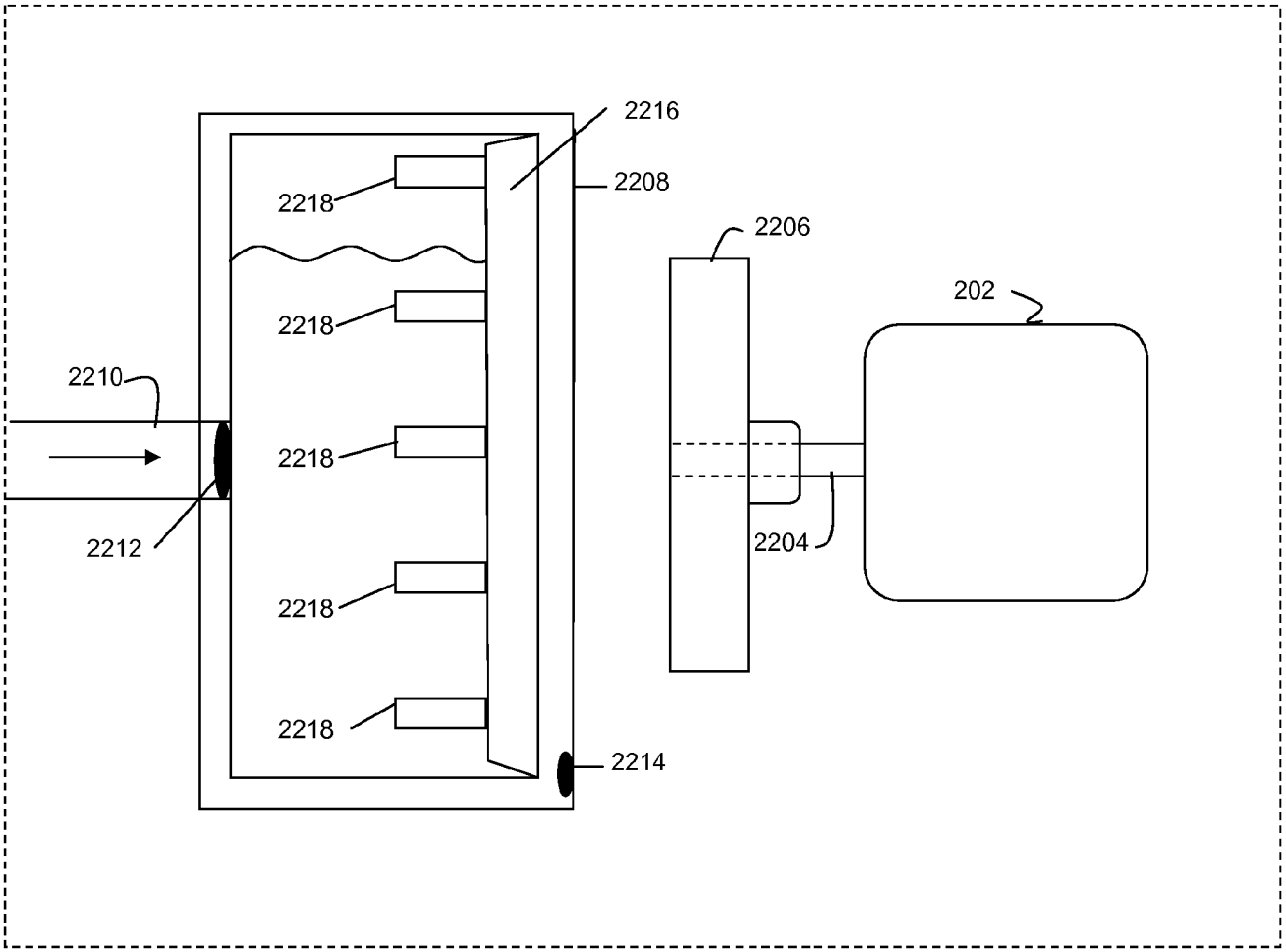
FIG. 22 is an enlarged sectional view of internal components of a seventh embodiment according to an exemplary embodiment.

A seventh embodiment of a magnet heater 2200 is illustrated in FIGS. 22. Like the fifth and sixth embodiment, the seventh embodiment of the magnet heater 2100 may be applied to heating fluids, including liquids.

Referring to FIG. 22, a motor 2202 is connected to a drive shaft 2204 to drivably rotate an rotor 2206. The motor 2202 may be an electric motor, an internal combustion motor, or any other type of motor configured to rotate the drive shaft 2204 and thereby rotate the rotor 2206. The rotor 2206 may be a substantially similar rotor as the rotor of the first through fourth embodiment (for example see FIGS. 18C and 18D). More specifically, a plurality of magnets, where each magnet is adjacent, along an annular direction, to a magnet having an opposite polarity, are positioned in bores of the rotor 2206.

The copper tank 2208 has a tube 2210 that inputs fluid, and more specifically, a liquid, into the copper tank 2208 through an inlet 2212. The copper tank 2208 also includes an outlet 2214 that discharges heated fluid. FIG. 22 illustrates that the outlet 2214 at the bottom of the copper tank 2208, but the outlet 2214 may be located in any position on the copper tank 2208. The outlet 2212 may include a valve that opens and closes according to an external condition, such as the temperature of the fluid in the tank 2208, or the fluid level within the tank 2208, a timer, or other factors.

The copper tank 2208 further includes a ferrous plate 2216 that is proximate and touching one side of the copper tank 2208. The ferrous plate 2216 may comprise steel or any other type of ferrous material. A flat surface of the ferrous plate 2216 may be flush against a flat surface of the copper tank 2208 A plurality of fins 2218 are connected to the ferrous plate 2216. The plurality of fins 2218 extend away from the rotor 2206 into the copper tank 2208. The plurality of cooling fins 2218 conduct heat from the ferrous plate 2216 and transfer heat to the fluid in the copper tank 2208. The plurality of fins 2218 on the ferrous plate 2216 may have a configuration similar to the two configurations illustrated in FIGS. 18E and 18F, or any other configuration that increases the surface area of the ferrous plate 2216.

The rotor 2206 rotates next to the copper tank 2208 near the side of the copper tank 2208 that is connected to the ferrous plate 2216. The magnets included in the rotor 2206 create a magnetic field with the ferrous plate 2216, thereby producing heat in the ferrous plate 2216 and the copper tank 2208. The ferrous plate 2216 and the copper tank 2208 transfer heat to the fluid within the copper tank 2208.

There have been shown and described several embodiments of heat generators having permanent magnets. Changes in materials, structures, arrangement of structures and magnets can be made by persons skilled in the art without departing from the invention.

The embodiments described above are intended to be exemplary. One skilled in the art recognizes that numerous alternative components and embodiments that may be substituted for the particular examples described herein and still fall within the scope of the invention.

What is claimed is:

1. A heater comprising:

a rotor including a plurality of fins and an absorber plate configured to rotate within a heating housing that has an inlet for receiving fluid and an outlet for discharging fluid, wherein fluid is discharged through the outlet by the rotation of the plurality of fins;

a plurality of permanent magnets mounted on a non-ferrous member, each magnet is adjacent to a magnet of opposite polarity; and a motor operable to rotate a drive that rotates the rotor within the heating housing to generate a magnetic field, thereby generating heat that heats the fluid within the heating housing.

2. The heater of claim 1, wherein the drive is a drive shaft.

3. The heater of claim 2, wherein the drive shaft passes through a hole in the non-ferrous member and supports the non-ferrous member.

4. The heater of claim 3, further comprising a bearing included on the non-ferrous member that prevents the non-ferrous member from rotating with the rotation of the drive shaft.

5. The heater of claim 1, further comprising a seal positioned around the drive within the heating housing that prevents the fluid from escaping through a hole in the heating housing where the drive enters the heating housing.

6. The heater of claim 1, wherein the non-ferrous member is secured to the heating housing.

7. The heating of claim 2, wherein the plurality of fins are connected the drive shaft and extend in opposite directions away from the drive shaft.

8. The heater of claim 7, wherein the plurality of fins are connected to the absorber plate.

9. The heater of claim 1, wherein the absorber plate comprises copper.

10. The heater of claim 1, wherein the heating housing is secured to a housing that houses all of the components of the heater to prevent rotation of the heating housing.

11. The heater of claim 2, wherein the heating housing includes a bearing that prevents rotation of the heating housing with the rotation of the drive shaft.

12. The heater of claim 1, wherein the heating housing comprises aluminum, stainless steel, or high temperature plastic.

13. The heater of claim 1, wherein the fins comprise aluminum casting.

14. The heater of claim 1, further comprising a pump that pumps the fluid into the heating housing through the inlet.

15. The heater of claim 1, wherein the absorber plate comprises metal.

16. The heater of claim 1, wherein the absorber plate comprises aluminum.

17. A heater comprising:

a rotor including a plurality of fins and an absorber plate configured to rotate within a heating housing that has an inlet for receiving fluid and an outlet for discharging fluid, wherein fluid is discharged through the outlet by the rotation of the plurality of fins;

a plurality of permanent magnets mounted on a non-ferrous member, each magnet is adjacent to a magnet of opposite polarity;

a motor operable to rotate a drive that rotates the rotor within the heating housing to generate a magnetic field, thereby generating heat that heats the fluid within the heating housing; and a pump connected to a filtration system that pumps fluid into the heating housing through inlet.

18. The heater of claim 17, wherein the absorber plate comprises metal.

19. The heater of claim 17, wherein the absorber plate comprises aluminum.

20. The heater of claim 17, wherein each of the plurality of fins each extends away from the drive in a different direction, and the drive connects to the rotor at a center point of the rotor.

* * * * *